United States Patent [19]

Sawada et al.

[11] 4,346,165

[45] Aug. 24, 1982

[54] PROCESS FOR IMPROVING LIGHT FASTNESS OF COLOR IMAGES

[75] Inventors: Satoru Sawada; Shigeru Oono; Nobuo Seto; Yoshiaki Suzuki; Kotaro Nakamura; Nobuo Furutachi, all of Minami-ashigara, Japan

[73] Assignee: Fuji Photo Film Co., Ltd., Kanagawa, Japan

[21] Appl. No.: 223,665

[22] Filed: Jan. 19, 1981

[30] Foreign Application Priority Data

Jan. 9, 1980 [JP] Japan ..... 55-1635

[51] Int. Cl.[3] ..... G03C 7/00

[52] U.S. Cl. ..... 430/372; 430/386; 430/387; 430/551; 430/554; 430/555

[58] Field of Search ..... 430/17, 372, 386, 387, 430/551, 554, 555

[56] References Cited

U.S. PATENT DOCUMENTS 4,178,184 12/1979 Taguchi et al. ..... 430/551
4,239,843 12/1980 Hara et al. ..... 430/551
4,245,018 1/1981 Hara et al. ..... 430/14

*Primary Examiner*—J. Travis Brown
*Attorney, Agent, or Firm*—Sughrue, Mion, Zinn, Macpeak & Seas

[57] ABSTRACT

A process for improving the light fastness of a magenta color image which comprises introducing a specific complex and a specific discoloration prevention aid into a layer bearing the magenta color image.

54 Claims, No Drawings

PROCESS FOR IMPROVING LIGHT FASTNESS OF COLOR IMAGES

BACKGROUND OF THE INVENTION

This invention relates to a silver halide color photographic light-sensitive element and more particularly to a silver halide color photographic light-sensitive element capable of providing a magenta color image in which discoloration scarcely occurs even if the image is exposed to light for a long period of time.

As is well known in the art, when a silver halide color photographic element is color-developed, an oxidized aromatic primary amine color developing agent reacts with a coupler agent to form a dye, such as an indophenol, indoaniline, indamine, azomethine, phenoxazine, phenazine compound, or the like, resulting in the formation of a color image.

In this type of system, the subtractive color process is usually employed for color reproduction, and silver halide emulsions selectively sensitive to blue, green, and red are used in combination with complementary color (yellow, magenta, and cyan, respectively) image-forming agents. For formation of a yellow color image, for example, acylacetanilide or a dibenzoylmethane coupler is used; for formation of a magenta color image, a pyrazolone, pyrazolobenzimidazole, cyanoacetophenone or imidazolone coupler is used; and for formation of a cyan color image, a phenol coupler, e.g., phenols and naphthols, is typically used.

However, such color images tend to become discolored when it is exposed to high intensity light. In particular, the discoloration of the magenta color image by exposure to light proves a serious hindrance to the stable storage of color photographs for a long period of time.

Certain attempts to make the magenta color image obtained using 3-anilino-5-pyrazolones light fast have heretofore been made. For example, (1) an ultraviolet ray absorbing agent to protect the color image from ultraviolet rays may be incorporated into the color photographic element; (2) the dye per se may be made more light fast by suitably selecting the structure of the coupler; and (3) a discoloration preventing agent may be incorporated to prevent the decomposition of the dye caused by light.

As such discoloration preventing agents, substituted hydroquinones, α-tocophenols, 6-hydroxycumarones, 5-hydroxycumaranes, 6,6'-dihydroxy-4,4,4',4'-tetramethyl-bis-2,2'-spirocumarone derivatives, sterically-hindered phenol compounds, alkoxyphenols, etc., are known. Recently, compounds prepared by replacing the hydroxy group of the above-described hydroquinone derivatives, phenol derivatives and cumarone derivatives, e.g., tocophenol, by an alkoxy group, an acyloxy group, etc., have been proposed.

These compounds are somewhat effective in preventing the discoloration of the magenta color image. However, they suffer the disadvantages that the effect of preventing the discoloration is small and that even though they are somewhat effective in preventing the discoloration, they deteriorate the hue, produce fog, cause insufficient dispersion, and produce crystals. Thus, there is a continuing color image stabilizers exhibiting generally excellent effects for photography.

A method of stabilizing a dye by using a metal complex is disclosed in Japanese Patent Application (OPI) No. 87649/75 (The term "OPI" as used herein refers to a "published unexamined Japanese patent application") and *Research Disclosure,* 15162 (1976). Metal complexes as disclosed therein, however, are not high in the effect of preventing the discoloration per se, and furthermore are not high in the solubility in a solvent as a photographic additive. It is, therefore, not possible to add the metal complexes in amounts sufficient to exhibit the effect of preventing discoloration. Moreover, since the metal complexes per se are highly colored, addition of a large amount of such complexes exerts adverse influences on the hue and purity of the image.

Although the technique to make light fast yellow color images and cyan color images has been substantially achieved by long and continuing studies, light fastness of magenta color images is not still sufficient. Thus, it has greatly been desired to improve the light fastness of magenta color images in order to maintain a good balance of light fastness.

SUMMARY OF THE INVENTION

An object of this invention is to provide a method of improving the light fastness of a magenta color image of a color photograph, and a color photographic light-sensitive element which provides an image which is improved in light fastness.

Another object of this invention is to provide a color photographic light-sensitive element in which no yellow strains are formed in unexposed areas after development by light, heat, and/or moisture.

Other objects will become apparent from the detailed explanation and examples as hereinafter described.

These objects are attained by incorporating at least one member of complexes represented by formulae (I), (II), (III), and (IV), described hereinafter, and at least one member of discoloration-prevention aids represented by formulae (V), (VI), and (VII), also described hereinafter, into a layer containing a magenta color image (non-diffusible) which is formed by oxidation coupling of an oxidized product of an aromatic primary amine developing agent and a 3-anilino type magenta coupler.

DETAILED DESCRIPTION OF THE INVENTION

The method of this invention permits preparation of a silver halide color photographic light-sensitive element capable of providing a magenta color image having a highly improved light fastness. In accordance with the method of this invention, not only is the improvement in the light fastness of the magenta color image attained, but also yellow discoloration of non-image areas of a color photography after development is substantially prevented.

Thus the method of this invention produces an effect of improving the light fastness of the magenta color image that could not be expected when a compound to aid the prevention of discoloration is used singly. This is an effect called "synergism" in the field of anti-oxidants. It is very unexpected that such synergism has been discovered in increasing the light fastness of the magenta color image of the color photographic light-sensitive element.

The method of this invention, exhibiting the synergism of the complex and the organic discoloration prevention aid in improving the light-fastness of a color image obtained from the 3-anilino-5-pyrazolone type magenta coupler without exerting any adverse influences on photographic characteristics, is a very useful technique in such a complex technology as color photography.

The term "layer containing a magenta color image" as used in this invention usually means a green-sensitive emulsion layer, but where the magenta dye formed diffuses and is fixed in a layer other than the emulsion layer (for example, an image-receiving layer in the diffusion transfer photographic process), it means a layer in which the dye is fixed.

The 3-anilino-5-pyrazolone type magenta coupler as used in this invention includes those compounds represented by formula (IX)

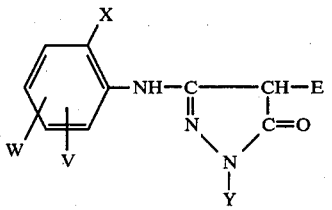

(IX)

wherein

X is an alkyl group (e.g., methyl, tert-butyl, octyl, dodecyl, etc.), an alkoxy group (e.g., methoxy, octyloxy, etc.), an alkylthio group (e.g., methylthio, butylthio, dodecylthio, etc.), an amido group (e.g., acetamido, butyramido, methylsulfonamido, diacylamido, succinimido, etc.), a halogen atom (e.g., fluorine, chlorine, bromine, etc.), a hydroxy group or a cyano group;

Y is an aryl group (e.g., phenyl, 2-chlorophenyl, 4-chlorophenyl, 2,5-dichlorophenyl, 2,6-dichlorophenyl, 2,4,6-trichlorophenyl, 2-bromophenyl, 3,5-dibromophenyl, 2-cyanophenyl, 4-cyanophenyl, 3-nitrophenyl, 4-nitrophenyl, 4-methylphenyl, 2,6-dimethylphenyl, 2,6-diethylphenyl, 4-butylphenyl, 2-trifluoromethylphenyl, 2,6-dichloro-4-methoxycarbonylphenyl, 2,6-dichloro-4-tetradecyloxycarbonylphenyl, 2,6-dichloro-4-cyanophenyl, 2-ethoxyphenyl, 4-phenylphenyl, 4-phenoxyphenyl, 2-methyl-5-nitrophenyl, 2-chloro-5-cyanophenyl, 5-chloro-2-methylphenyl, 2,6-dichloro-4-methylphenyl, 2,4-dichloro-6-methoxycarbonylphenyl, 2,4-dichloro-6-methylphenyl, 2-chloro-4,6-dimethylphenyl, 2,6-dichloro-4-methoxyphenyl, 2,6-dichloro-4-nitrophenyl, 2,6-dichloro-4-acetamidophenyl, 2,6-dichloro-4-tetradecanamidophenyl, 2,4,6-trimethyl-3-nitrophenyl, 2,4,6-trimethyl-3-acetamidophenyl, etc.) or a heterocyclic group (e.g., 5- and 6-membered heterocyclic compounds such as 2-thiazolyl, 2-benzothiazolyl, 2-benzoxazolyl, 2-oxazolyl, 2-imidazolyl, 2-benzimidazolyl, etc.);

E is hydrogen or a coupling-off group;

W is hydrogen or a hydrophobic group; and

V is hydrogen or a group as described for X or W.

Typical hydrophobic groups include an alkyl group, an alkenyl group, an alkoxyalkyl group, an alkyl-substituted aryl group, an alkoxy-substituted aryl group, a terphenyl group, etc. These groups may be substituted, for example, by a halogen atom, e.g., fluorine and chlorine, a nitro group, a cyano group, an alkoxycarbonyl group, an amido group, a carbamoyl group, a sulfonamido group, etc.

At least one of V, W, and Y is required to be a hydrophobic group capable of functioning as a ballast group.

The hydrophobic group capable of functioning as the ballast group in the magenta color-forming coupler as used in this invention suitably contains at least 8 carbon atoms. For normal purposes, those containing up to about 32 carbon atoms are useful. As described, for example, in U.S. Pat. Nos. 2,600,788, 2,865,751, 3,337,344, 3,418,129, Japanese Patent Publication Nos. 27563/64 and 19035/70, a great number of suitable hydrophobic ballast groups are known, and they are advantageously used in this invention.

Representative examples of such groups are shown below:

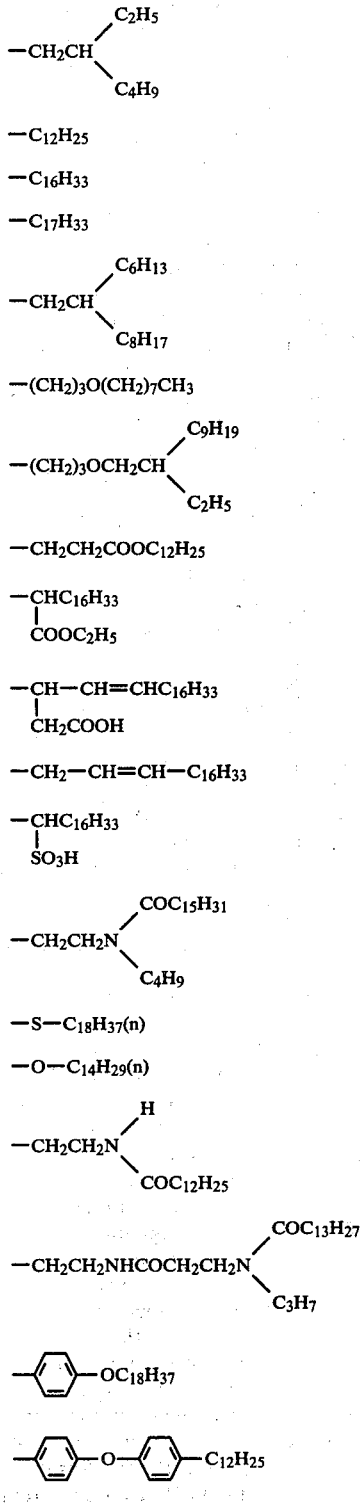

-continued

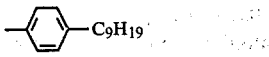

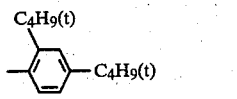

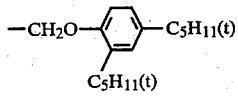

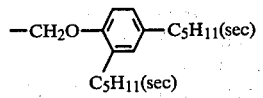

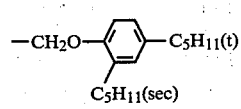

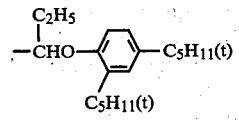

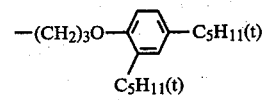

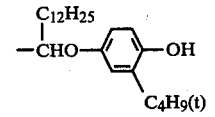

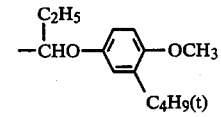

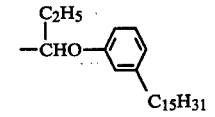

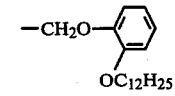

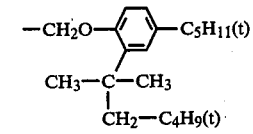

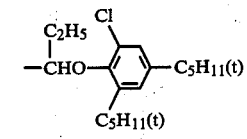

These hydrophobic ballast groups may have, as a portion linking the anilino group to the aromatic nucleus, the following bonds:

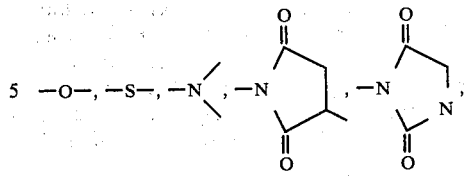

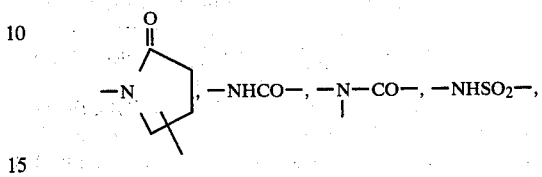

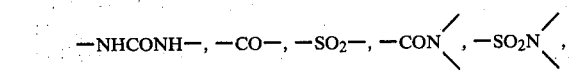

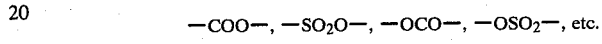

The term "coupling-off group" represented by B has the same meaning as usually used in connection with the color-forming coupler; that is, it represents a group capable of being released from the active carbon atom at the coupling position when coupling of the coupler and the oxidized product of the aromatic primary amine color developing agent occurs.

The term "hydrophobic ballast group" as used in this invention has the same meaning as usually used in connection with the color-forming coupler; that is, it represents a hydrophobic group which is introduced into the coupler molecule in order to fix the coupler in a specified hydrophilic colloid layer and to make it nondiffusible.

Examples of the coupling-off group in the magenta color-forming coupler as used in this invention include those groups linked to the coupling position of so-called colored couplers as described in U.S. Pat. Nos. 2,455,170, 2,688,539, 2,725,292, 2,983,608, 3,005,712, British Pat. Nos. 800,262, 1,044,778, etc., those groups linked to the coupling position of so-called development-inhibiting compound releasing type (DIR) couplers as described in U.S. Pat. Nos. 3,148,062, 3,227,554, 3,933,500, 3,617,291, etc., and those groups linked to the coupling position of couplers as described in U.S. Pat. Nos. 3,006,759, 3,214,437, 3,311,476, 3,419,391, 3,926,631, British Patent 1,470,552, etc.

Typical examples of such groups include a thiocyano group, an acyloxy group (e.g., acetoxy, dodecanoyloxy, octadecanoyloxy, 3-pentadecylphenoxyacetoxy, benzoyloxy, β-naphthoyloxy, 3-[γ-(2,4-di-tert-amylphenoxy)butyramido]benzoyloxy, etc.), an aryloxy group (e.g., phenoxy, p-chlorophenoxy, p-nitrophenoxy, naphthoxy, etc.), an aralkyloxycarbonyloxy group (e.g., benzyloxycarbonyloxy, etc.), an alkyloxycarbonyloxy group (e.g., ethyloxycarbonyloxy, etc.), a halogen atom (e.g., Cl, Br, F, etc.), an arylazo group (e.g., phenylazo, hydroxyphenylazo, chlorophenylazo, methylphenylazo, methoxyphenylazo, naphthylazo, etc.), a 2-artyltriazolyl group (e.g., 2-benzotriazolyl, 2-naphthotriazolyl, etc.), an alkylthio group (e.g., alkylthio containing 4 to 10 carbon atoms, etc.), an arylthio group (e.g., phenylthio, naphthylthio, etc.), a heterothio group (e.g., 2-benzothiazolylthio, 1-phenyl-5-tetrazolylthio, 2-benzoxazolylthio, 2-benzimidazolylthio, 5-phenyl-1,3,4-oxadiazolyl-2-thio, etc.), a cycloalkylthio group (.e.g, cyclohexylthio, etc.), an alkylthio group (e.g., ethylthio, dodecylthio, γ-phenoxypropylthio, etc.), a cycloalkoxy group (e.g., cyclohexyloxy, etc.), an alkoxycarbonyloxy group (e.g., ethoxycarbonyloxy, benzyloxycarbonyloxy, etc.), a diazolyl group (e.g., 1-imidazolyl, 1-pyrazolyl, 4-methyl-1-imidazolyl, etc.), a triazolyl group (e.g., 1,2,4-1-triazolyl, 3,5-diethyl-1,2,4-1-triazolyl, etc.), etc.

Bispyrazolones obtained by bonding two pyrazolone molecules through V, W, Y or B as described in formula (IX) are also included in the 3-anilino-5-pyrazolone type magenta coupler as used in this invention.

Of the compounds represented by formula (IX), those compounds wherein Y is a phenyl group containing at at least one ortho-position a halogen atom, an alkyl group, an alkoxy group, a carboxy group, an alkoxycarbonyl group, an acylamino group or a cyano group are excellent in that the stability against heat and light of the coupler per se is high and that even though they remain in a color photograph, they rarely cause color contamination.

Of the magenta color-forming couplers used in this invention, those compounds represented by formula (X) below are particularly useful.

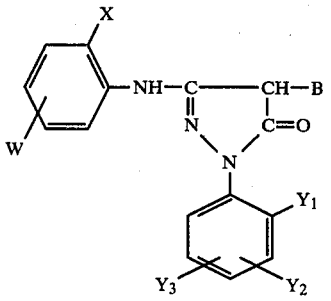

(X)

wherein W and B each has the same meaning as defined in formula (IX), X is an alkyl group containing from 1 to 4 carbon atoms, an alkoxy group containing from 1 to 4 carbon atoms, a halogen atom, a hydroxy group, a cyano group or a nitro group, $Y_1$ is a halogen atom, an alkyl group, an alkoxy group, an alkoxycarbonyl group, a nitro group, an aryloxy group, a cyano group or an acylamino group, and $Y_2$ and $Y_3$ may be the same or different and represents hydrogen or a group as described for $Y_1$.

The number of carbon atoms contained in the groups represented by $Y_1$, $Y_2$ and $Y_3$ in formula (X) is suitable to be up to about 6 in each case.

In particular, those compounds of formula (X) wherein the substituted phenyl group at the 1-position of pyrazolone is 2,4-dichlorophenyl, 2,5-dichlorophenyl, 2,6-dichlorophenyl, 2,4,6-trichlorophenyl, 2,5-dibromophenyl, 2,4-dibromophenyl, 2,6-dibromophenyl, 2,4,6-tribromophenyl, 2,4-dichloro-6-methylphenyl, 2,4-dimethyl-6-chlorophenyl, 2,6-dichloro-4-methylphenyl, 2,6-dichloro-4-tetradecaneamidophenyl, 2,4-dichloro-6-methoxyphenyl, 2,6-dichloro-4-methoxyphenyl, 2-chloro-4-nitrophenyl, 2,6-dichloro-4-methoxycarbonylphenyl, 2,6-dichloro-4-tetradecyloxycarbonylphenyl, 2-chloro-5-nitrophenyl, or the like are particularly excellent, in that the extent of contamination due to the remaining coupler is low and that the spectral absorption of the dye formed has particularly desirable characteristics as a magenta color image in color-reproduction (i.e., the maximum absorption is in the wavelength region of 530 to 565 microns, and the absorptions in the blude and red regions are low).

Examples of suitable magenta color-forming couplers useful in this invention are shown below:

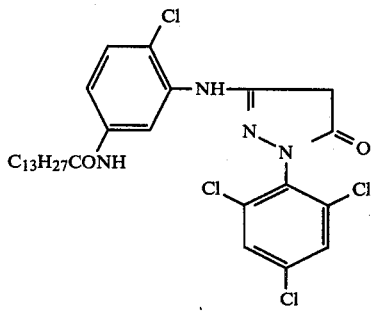

(1)

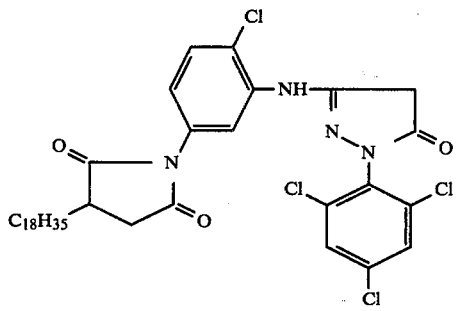

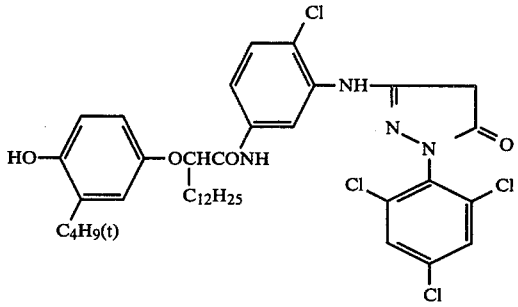

(3)

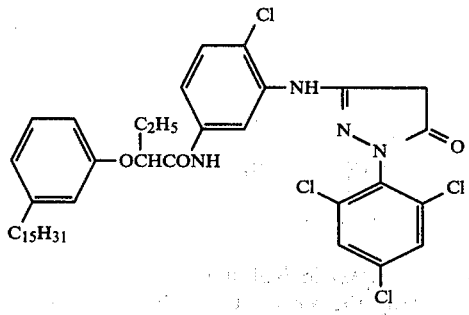

-continued
(5)
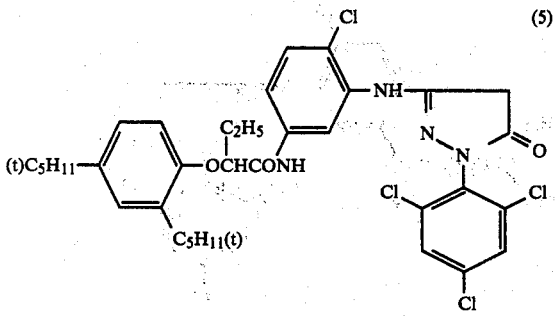
(6)
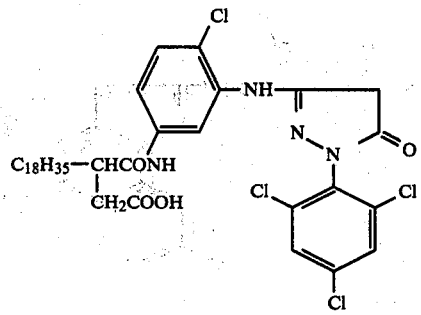
(7)
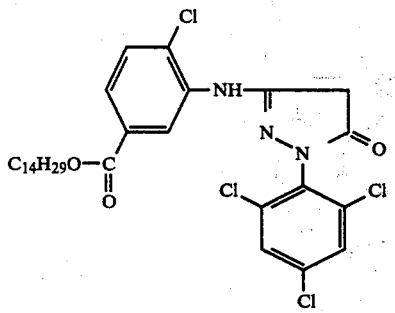
(8)
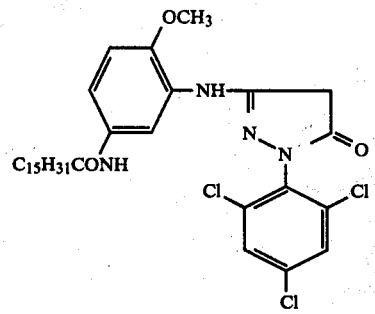
(9)
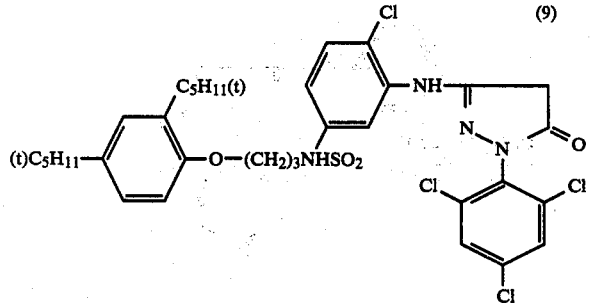
(10)
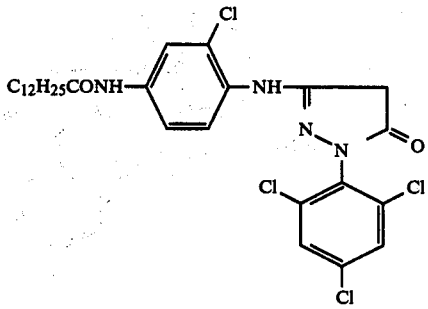
(11)
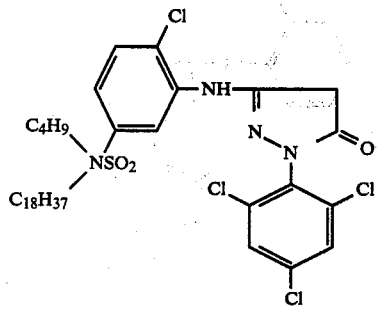
(12)
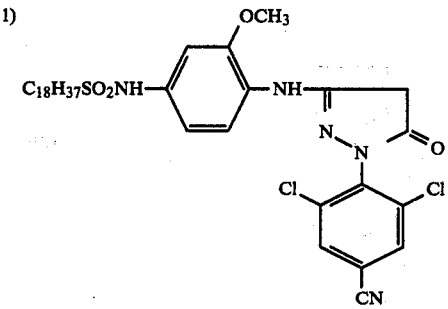
(13)
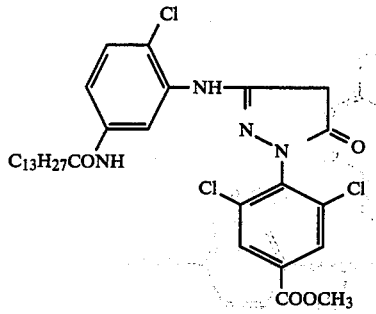
(14)
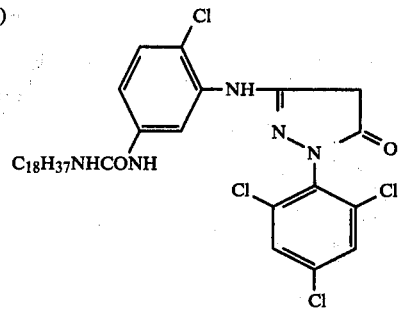

-continued
(15)
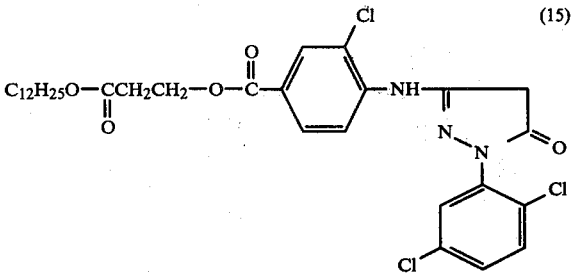
(16)
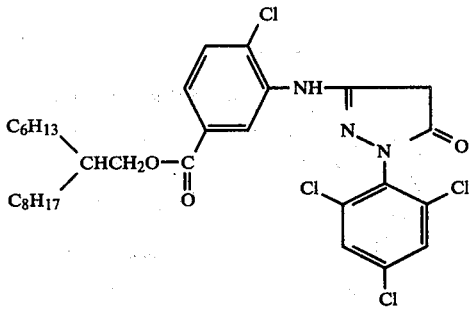
(17)
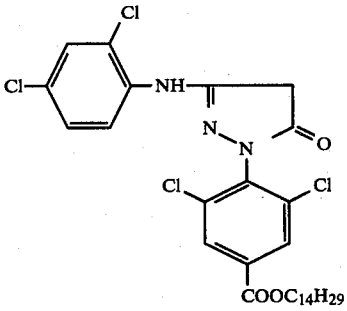
(18)
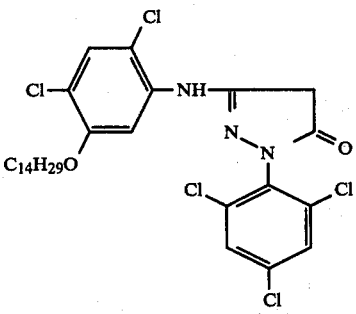
(19)
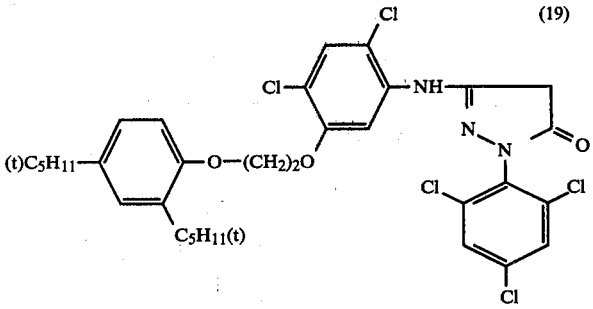
(20)
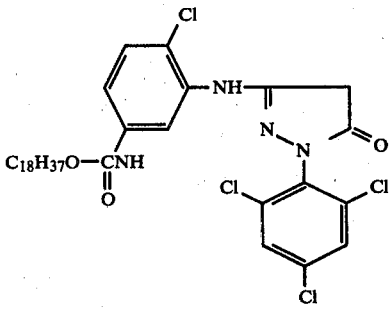
(21)
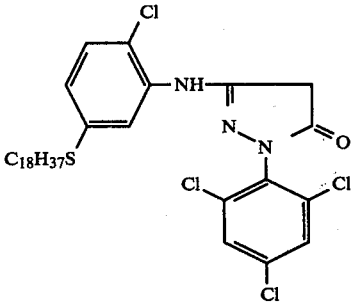
(22)
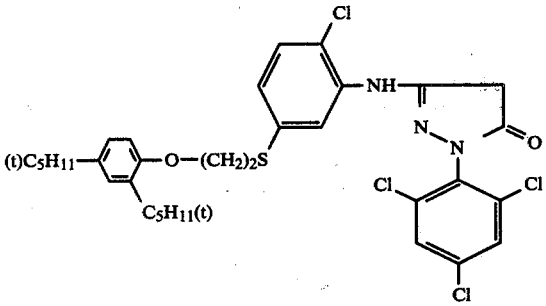
(23)
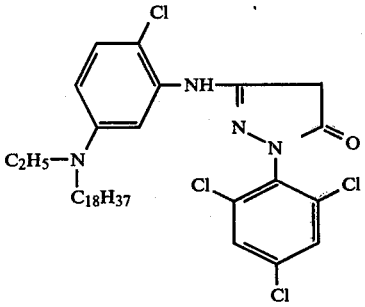
(24)
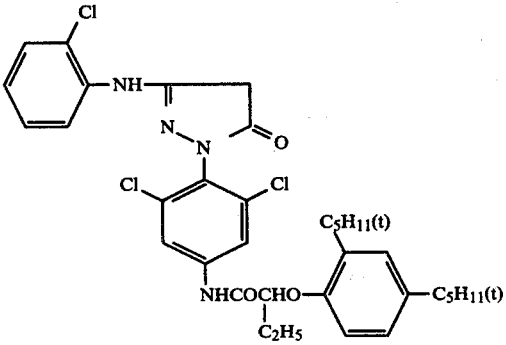

-continued
(25)
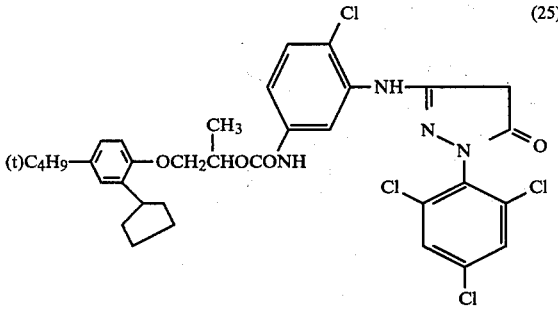
(26)
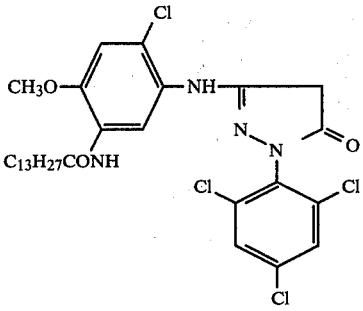
(27)
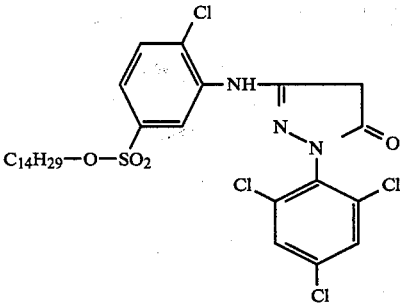
(28)
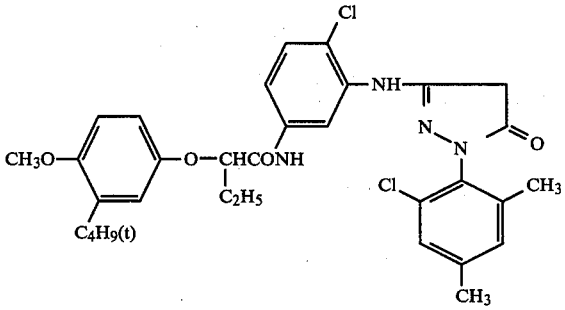
(29)
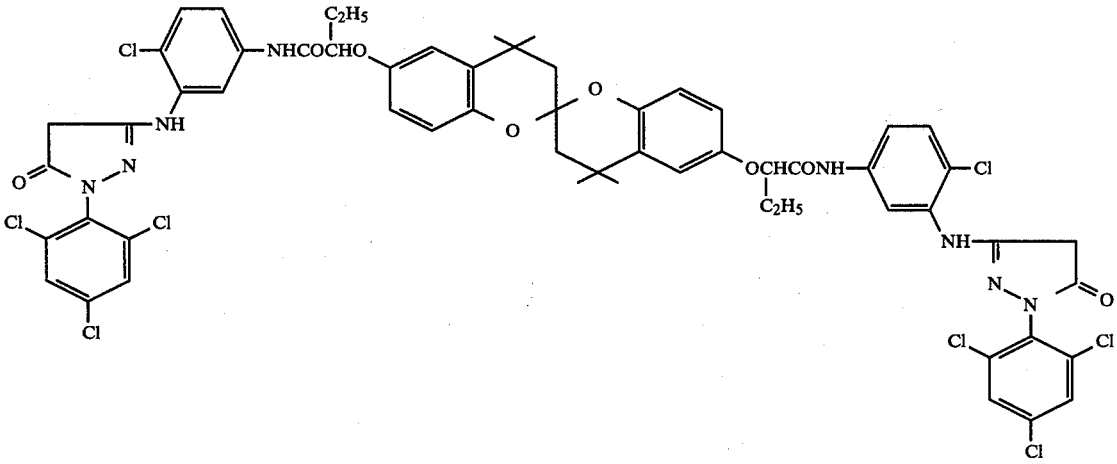
(30)
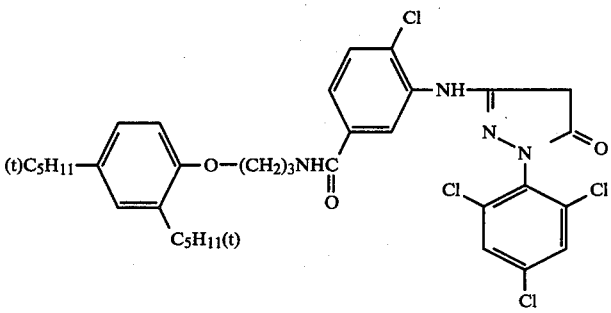

-continued
(31)
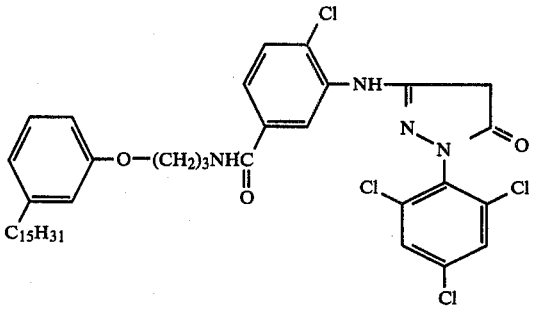
(32)
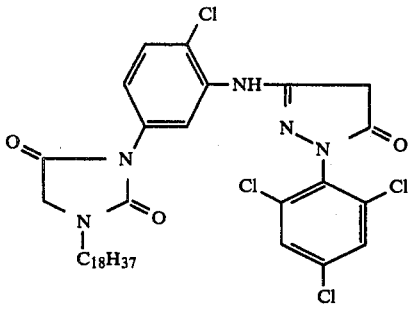
(33)
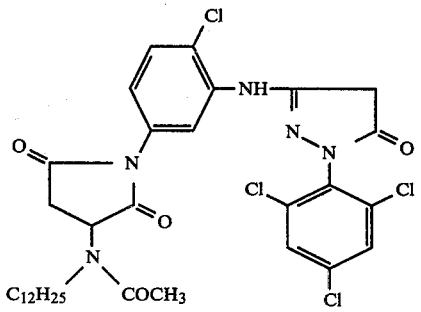
(34)
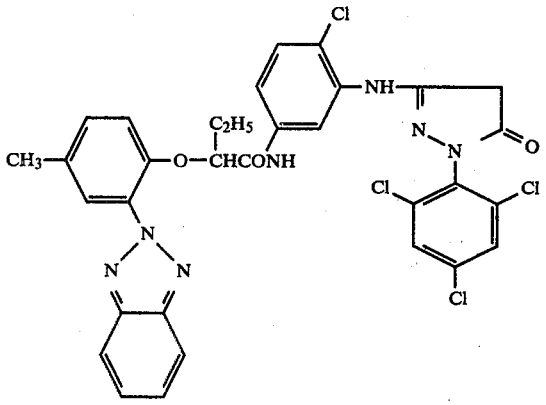
(35)
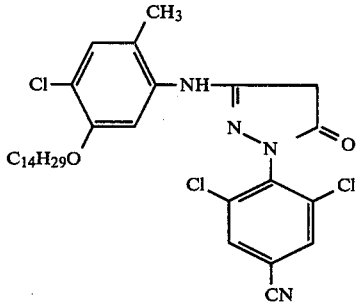
(36)
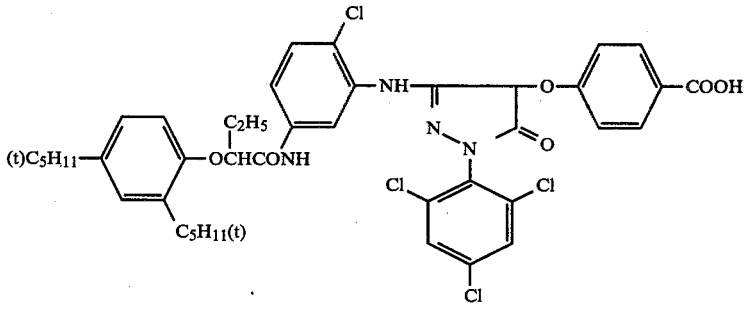
(37)
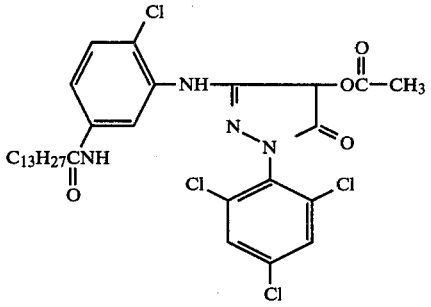

-continued
(38)
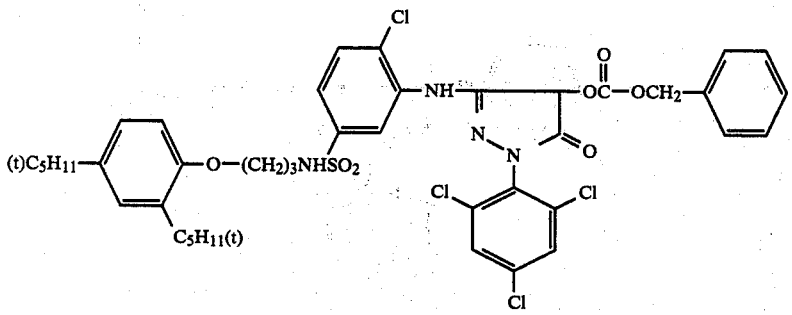
(39)
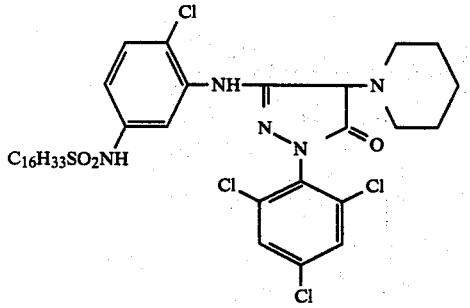
(40)
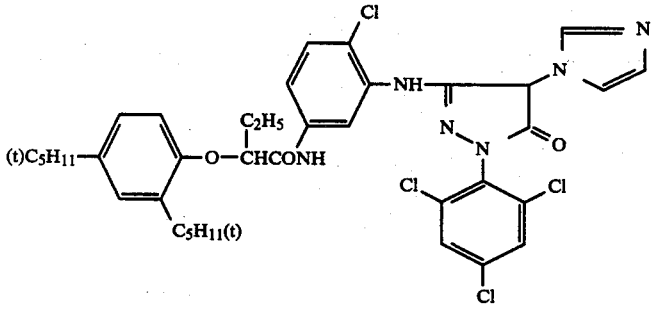
(41)
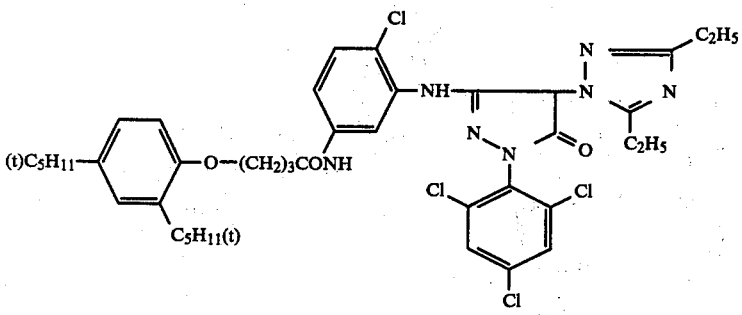
(42)
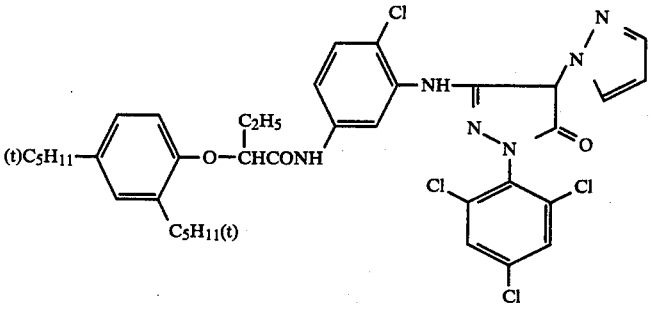

-continued
(43)
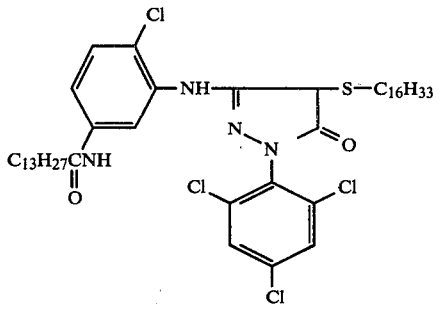
(44)
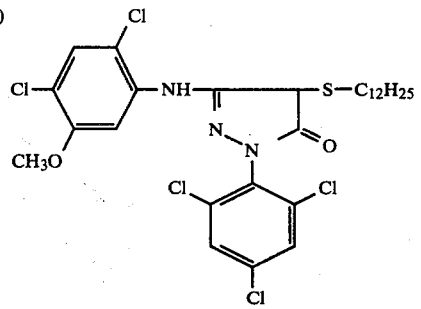
(45)
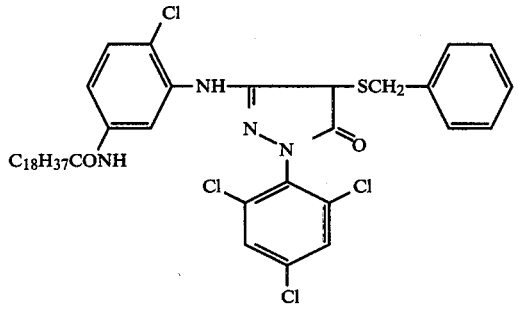
(46)
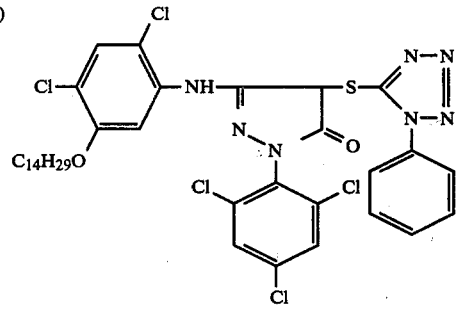
(47)
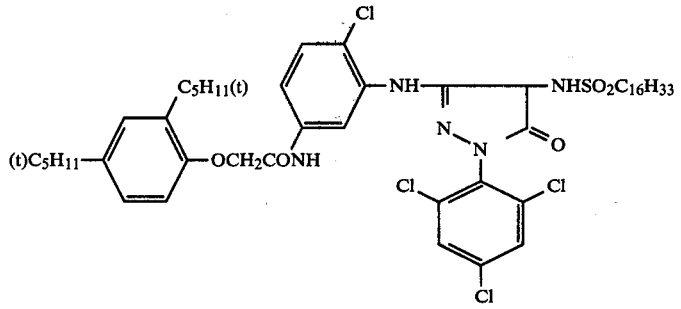
(48)
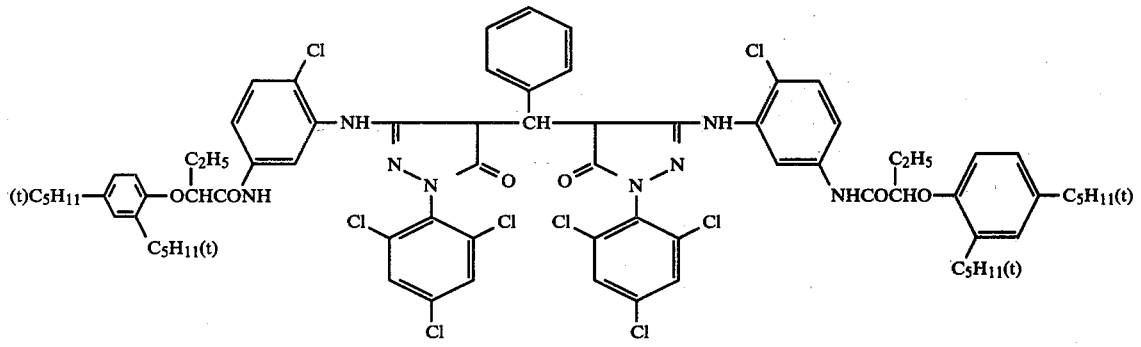
(49)
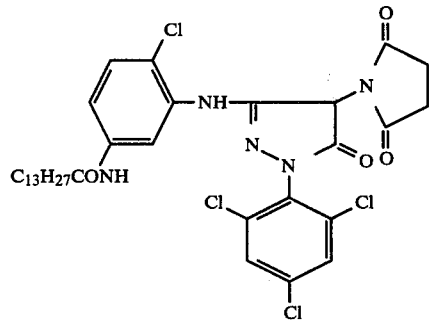

-continued
(50)
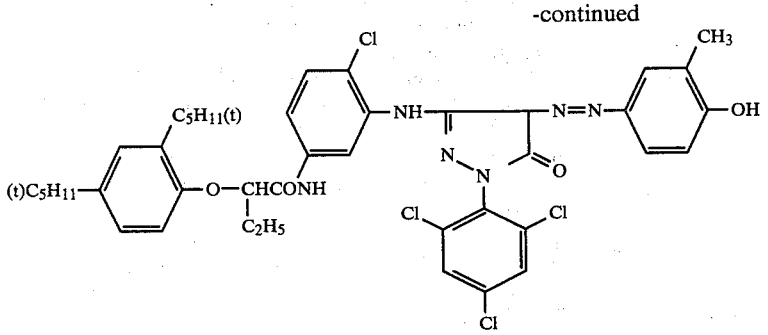
(51)
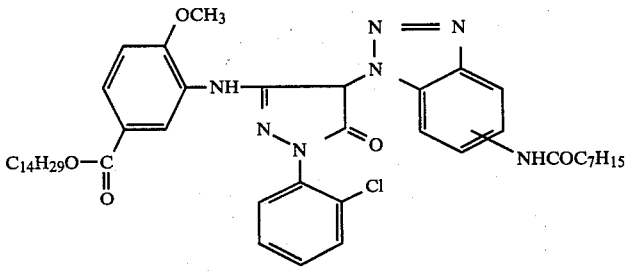
(52)
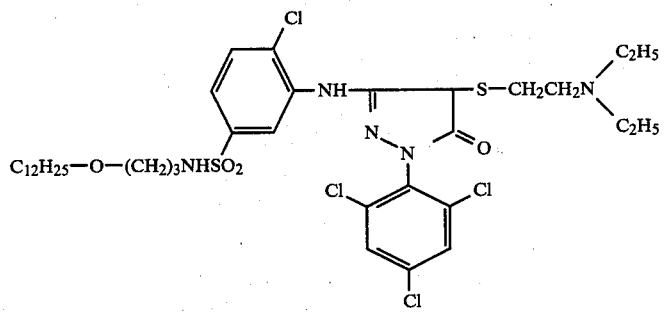
(53)
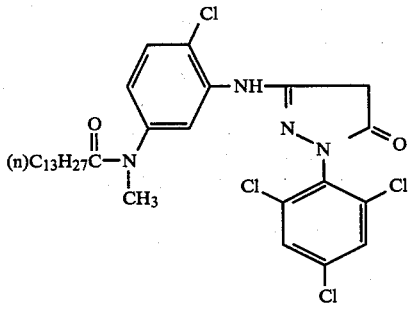
(54)
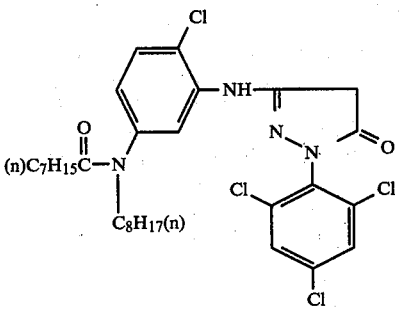
(55)
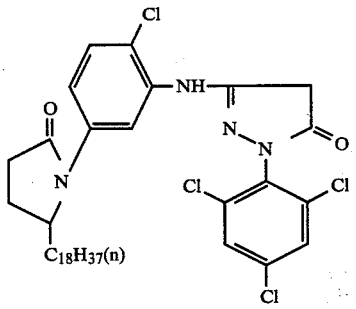
Complexes as used in this invention to improve the light fastness of the magenta color image are represented by formulae (I), (II), (III), and (IV)

(I)

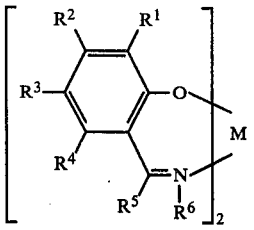

(II)

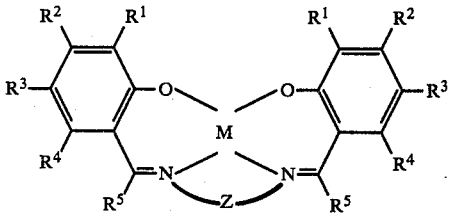

(III)

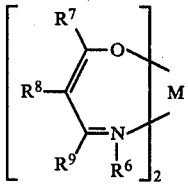

(IV)

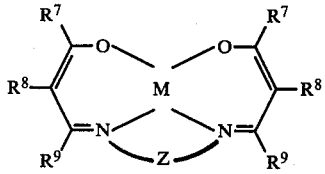

wherein

M is Cu, Co, Ni, Pd or Pt;

$R^1$, $R^2$, $R^3$, and $R^4$ are each hydrogen, a halogen atom, a cyano group, an alkyl group linked to the carbon atom of the benzene nucleus either directly or through a divalent linking group, an aryl group, a cycloalkyl group or a heterocyclic group, or $R^1$ and $R^2$, $R^2$ and $R^3$, or $R^3$ and $R^4$ represent a group of non-metalic atoms combining with each other to form a 6-membered ring;

$R^5$, $R^8$ and $R^9$ can each represent hydrogen, an alkyl group, or an aryl group, or $R^8$ and $R^9$ together represent a group of non-metallic atoms combining to form a 5- to 8-membered ring;

$R^6$ is hydrogen, an alkyl group, an aryl group or a hydroxy group; and $R^7$ can represent an alkyl group, an aryl group, or $R^7$ and $R^8$ together represent a group of non-metallic atoms combining to form a from 5- to 8-membered ring;

Z is a group of non-metallic atoms forming a 5- or 6-membered ring.

The halogen atoms represented by $R^1$, $R^2$, $R^3$ and $R^4$ include fluorine, chlorine, bromine, and iodine.

The alkyl groups represented by $R^1$, $R^2$, $R^3$, and $R^4$ preferably contain from 1 to 19 carbon atoms, and may be straight chain or branched chain, and substituted or unsubstituted.

The aryl groups represented by $R^1$, $R^2$, $R^3$, and $R^4$ preferably contain from 6 to 14 carbon atoms, and may be substituted or unsubstituted.

The heterocyclic rings represented by $R^1$, $R^2$, $R^3$, and $R^4$ are preferably 5- or 6-membered rings, and may be substituted or unsubstituted.

The cycloalkyl groups represented by $R^1$, $R^2$, $R^3$, and $R^4$ are preferably 5- or 6-membered rings, and may be substituted or unsubstituted.

The 6-membered rings formed by $R^1$ and $R^2$, $R^2$ and $R^3$, or $R^3$ and $R^4$ are preferably benzene rings. Such benzene rings may be substituted or unsubstituted, or may be part of a condensed ring structure.

The straight chain or branched chain alkyl groups represented by $R^1$, $R^2$, $R^3$, and $R^4$ include a methyl group, an ethyl group, a propyl group, a butyl group, a hexyl group, an octyl group, a decyl group, a dodecyl group, a tetradecyl group, a hexadecyl group, and an octadecyl group.

The aryl groups represented by $R^1$, $R^2$, $R^3$, and $R^4$ include a phenyl group, and a naphthyl group.

The heterocyclic rings represented by $R^1$, $R^2$, $R^3$, and $R^4$ include a 5- or 6-membered heterocyclic ring containing as a hetero atom at least one nitrogen atom, oxygen atom or sulfur atom in the ring thereof. Examples are a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group, a thiazolyl group, and the like.

The cycloalkyl groups represented by $R^1$, $R^2$, $R^3$, and $R^4$ include a cyclopentyl group, a cyclohexyl group, a cyclohexenyl group, a cyclohexadienyl group, etc.

The 6-membered rings obtained by the bonding of $R^1$ and $R^2$, $R^2$ and $R^3$, or $R^3$ and $R^4$ include, for example, a benzene ring, a naphthalene ring, an isobenzothiophene ring, an isobenzofuran ring, an isoindoline ring, etc.

The alkyl groups, cycloalkyl groups, aryl groups or heterocyclic rings represented by $R^1$, $R^2$, $R^3$, and $R^4$ may be linked to the respective carbon atoms of the benzene nucleus through a divalent linking group, e.g., an oxy group (—O—) a thio group (—S—), an amino group, an oxycarbonyl group, a carbonyl group, a carbamoyl group, a sulfamoyl group, a carbonylamino group, a sulfonylamino group, a sulfonyl group, or a carbonyloxy group.

Examples of the above-described groups comprising the alkyl group represented by $R^1$, $R^2$, $R^3$, and $R^4$ and the divalent linking group through which the alkyl group is linked to the carbon atom of the benzene nucleus include an alkoxy group (e.g., methoxy, ethoxy, butoxy, propoxy, n-decyloxy, n-dodecyloxy, n-hexadecyloxy, etc.), an alkoxycarbonyl group (e.g., methoxycarbonyl, ethoxycarbonyl, butoxycarbonyl, n-decyloxycarbonyl, n-hexadecycloxycarbonyl, etc.), an acyl group (e.g., acetyl, valeryl, stearoyl, benzoyl, toluoyl, etc.), an acyloxy group (e.g., acetoxy, hexadecylcarbonyloxy, etc.), an alkylamino group (e.g., n-butylamino, N,N-diethylamino, N,N-didecylamino, etc.), an alkylcarbamoyl group (e.g., butylcarbamoyl, N,N-diethylcarbamoyl, n-dodecylcarbamoyl, etc.), an alkylsulfamoyl group (e.g., butylsulfamoyl, N,N-diethylsulfamoyl, n-dodecylsulfamoyl, etc.), a sulfonylamino group (e.g., methylsulfonylamino, butylsulfonylamino, etc.), a sulfonyl group (e.g., mesyl, ethanesulfonyl, etc.), an acylamino group (e.g., acetylamino, valerylamino, palmitoylamino, benzoylamino, toluoylamino, etc.), etc.

Examples of those groups comprising the cycloalkyl groups represented by $R^1$, $R^2$, $R^3$, and $R^4$ and the divalent linking group through which the cyloalkyl group is linked to the carbon atom of the benzene nucleus include a cyclohexyloxy group, a cyclohexylcarbonyl group, a cyclohexyloxycarbonyl group, a cyclohexyl-amino group, a cyclohexenylcarbonyl group, a cyclohexenyloxy group, etc.

Examples of those groups comprising the aryl groups represented by $R^1$, $R^2$, $R^3$, and $R^4$ and the divalent linking group through which the aryl group is linked to the carbon atom of the benzene nucleus include an aryloxy group (e.g., phenoxy, naphthoxy, etc.), an aryloxycarbonyl group (e.g., phenoxycarbonyl, naphthoxycarbonyl, etc.), an acyl group (e.g., benzoyl, naphthoyl, etc.), an anilino group (e.g., phenylamino, N-methylanilino, N-acetylanilino, etc.), an acyloxy group (e.g., benzoyloxy, toluoyloxy, etc.), an arylcarbamoyl group (e.g., phenylcarbamoyl, etc.), an arylsulfamoyl group (e.g., phenylsulfamoyl, etc.), an arylsulfonylamino group (e.g., phenylsulfonylamino, p-tolylsulfonylamino, etc.), an arylsulfonyl group (e.g., benzenesulfonyl, tosyl, etc.), an acylamino group (e.g., benzoylamino, etc.), etc.

The alkyl groups, aryl groups, heterocyclic groups and cycloalkyl groups represented by $R^1$, $R^2$, $R^3$, and $R^4$, and the 6-membered ring formed by the bonding of $R^1$ and $R^2$, $R^2$ and $R^3$, or $R^3$ and $R^4$ may be substituted by a halogen atom (e.g., chlorine, bromine, fluorine, etc.), a cyano group, a straight chain or branched chain alkyl group (e.g., methyl, ethyl, propyl, butyl, hexyl, octyl, decyl, dodecyl, tetradecyl, hexadecyl, heptadecyl, octadecyl, methoxyethoxyethyl, etc.), an aryl group (e.g., phenyl, tolyl, naphthyl, chlorophenyl, methoxyphenyl, acetylphenyl, etc.), an alkoxy group (e.g., methoxy, ethoxy, butoxy, propoxy, methoxyethoxy, etc.), an aryloxy group (e.g., phenoxy, tolyloxy, naphthoxy, methoxyphenoxy, etc.), an alkoxycarbonyl group (e.g., methoxycarbonyl, butoxycarbonyl, phenoxymethoxycarbonyl, etc.), an aryloxycarbonyl group (e.g., phenoxycarbonyl, tolyloxycarbonyl, methoxyphenoxycarbonyl, etc.), an acyl group (e.g., formyl, acetyl, valeryl, stearoyl, benzoyl, toluoyl, naphthoyl, p-methoxybenzoyl, etc.), an acyloxy group (e.g., acetoxy, acyloxy, etc.), an acylamino group (e.g., acetamido, benzamido, methoxyacetamido, etc.), an anilino group (e.g., phenylamino, N-methylanilino, N-phenylanilino, N-acetylanilino, etc.), an alkylamino group (e.g., n butylamino, N,N-diethylamino, 4-methoxy-n-butylamino, etc.), a carbamoyl group (e.g., n-butylcarbamoyl, N,N-diethylcarbamoyl, n-butylsulfamoyl, N,N-diethylsulfamoyl, n-dodecylsulfamoyl, N-(4-methoxy-n-butyl)sulfamoyl, etc.), a sulfonylamino group (e.g., methylsulfonylamino, phenylsulfonylamino, methoxymethylsulfonylamino, etc.), a sulfonyl group (e.g., mesyl, tosyl, methoxymethanesulfonyl, etc.), etc.

The alkyl groups represented by $R^5$, $R^6$, $R^7$, $R^8$, and $R^9$ include both substituted alkyl groups and unsubstituted alkyl groups. They may be either straight chain or branched chain. The number of carbon atoms of the alkyl group, excluding the carbon atoms of the substituent portion, is preferably from 1 to 20. Examples of these alkyl groups are a methyl group, an ethyl group, a propyl group, a butyl group, a hexyl group, an octyl group, a decyl group, a dodecyl group, a tetradecyl group, a hexadecyl group, a heptadecyl group, an octadecyl group, etc.

The aryl groups represented by $R^5$, $R^6$, $R^7$, $R^8$, or $R^9$ include both substituted aryl groups and unsubstituted aryl groups. The number of carbon atoms of the aryl group, excluding the carbon atoms of the substituent portion, is preferably from 6 to 14. Examples of these aryl groups are a phenyl group, a tolyl group, a naphthyl group, etc.

Groups of non-metallic atoms necessary for forming the 5- or 6-membered ring, as represented by Z, include groups of non-metallic atoms represented by the following formulae (a), (b), (c), (d) and (e):

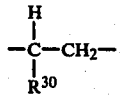
(a)

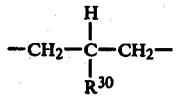
(b)

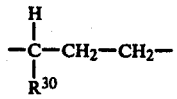
(c)

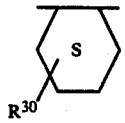
(d)

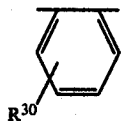
(e)

wherein $R^{30}$ represents hydrogen or an alkyl group.

The alkyl group represented by $R^{30}$ includes both a substituted alkyl group and an unsubstituted alkyl group. The number of carbon atoms of the alkyl group, excluding the carbon atoms of the substituent portion, is preferably from 1 to 20. The alkyl group may be either straight chain or branched chain. Examples of these alkyl groups are the same as described for $R^1$, $R^2$, $R^3$, and $R^4$.

The alkyl group represented by $R^{30}$ in formula (e) may be linked through a divalent linking group to the carbon atom of the benzene nucleus. Examples of such linking groups include those as described for $R^1$, $R^2$, $R^3$ and $R^4$.

Of the complexes as described hereinbefore, those complexes represented by formulae (I), (IIa), (IIIa), (IIIb) and (IVa) are preferably used in this invention.

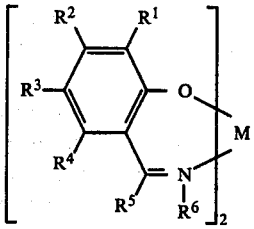
(I)

-continued

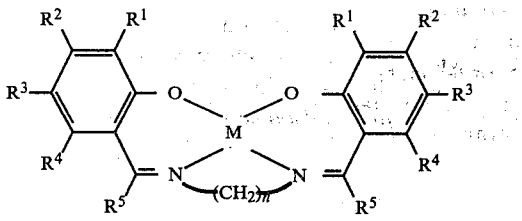

(IIa)

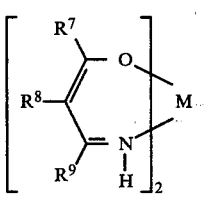

(IIIa)

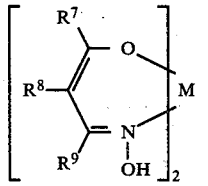

(IIIb)

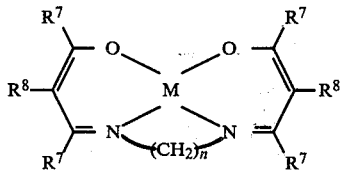

(IVa)

wherein $R^1$, $R^2$, $R^3$, $R^4$, $R^5$, $R^6$, $R^7$, $R^8$, $R^9$, and M each has the same meaning as defined above; and n is 2 or 3.

Examples of the alkyl group or aryl group represented by $R^7$, $R^8$, or $R^9$ include the same examples as described for $R^1$, $R^2$, $R^3$, $R^4$, and $R^5$.

Of the complexes represented by formulae (I), (IIa), (IIIa), (IIIb) and (IVa), those complexes represented by formulae (I) and (IIa) are especially preferably used in this invention. Of the complexes represented by formulae (I) and (IIa), those complexes wherein at least one of $R^1$, $R^2$, $R^3$, and $R^4$ is an alkyl group or an alkoxy group are more preferably used. More preferably, complexes represented by formulae (I) and (IIa) are used wherein the total number of carbon atoms contained in the groups represented by $R^1$, $R^2$, $R^3$, $R^4$, $R^5$, and $R^6$ is at least 4.

In the complexes represented by formulae (I), (II), (IIa), (III), (IIIa), (IIIb), (IV) and (IVa), Cu, Co and Ni are preferably used as M. In particular, Ni is more preferably used.

Representative examples of the complexes represented by formulae (I), (II), (III), and (IV) which can be effectively used in the practice of this invention are shown below, but this invention is not limited to these compounds.

I-1

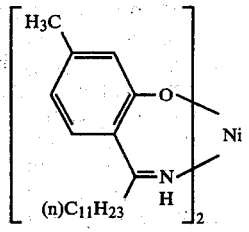

I-2

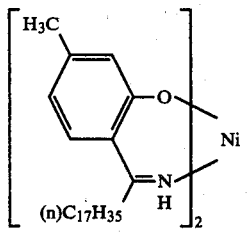

I-3

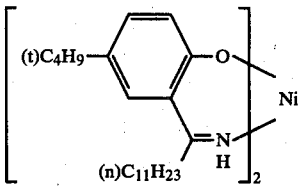

I-4

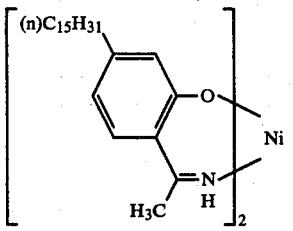

I-5

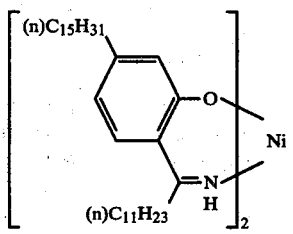

I-6

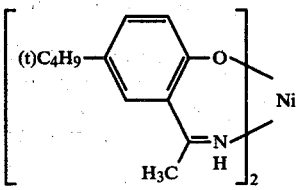

I-7

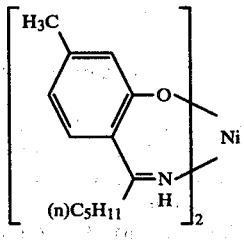

-continued
I-8
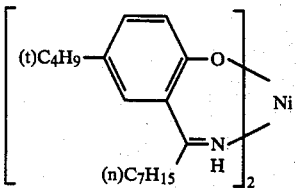
I-9
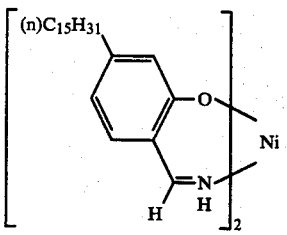
I-10
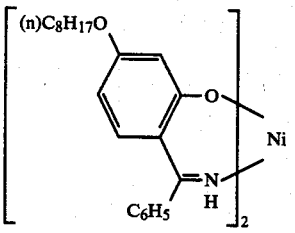
I-11
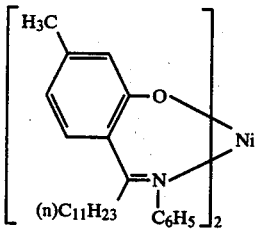
I-12
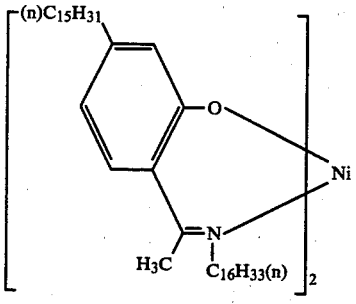
I-13
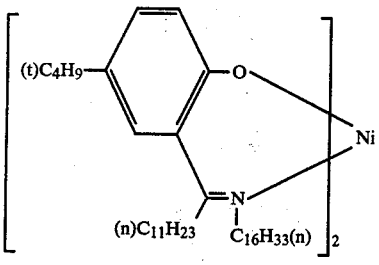
-continued
I-14
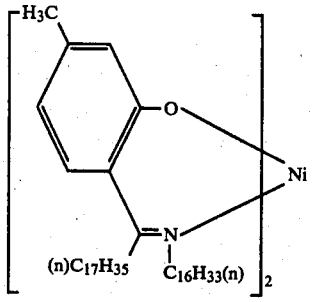
I-15
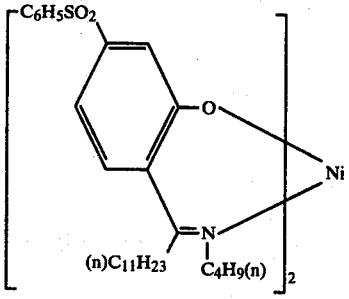
I-16
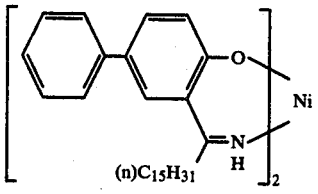
I-17
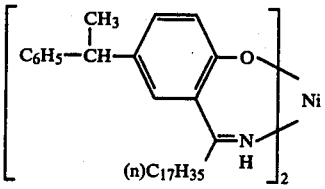
I-18
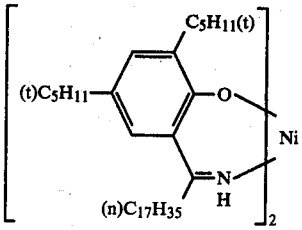
I-19
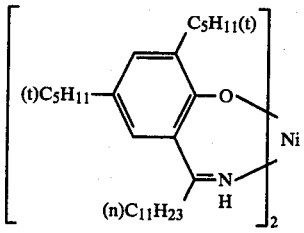

-continued
I-20
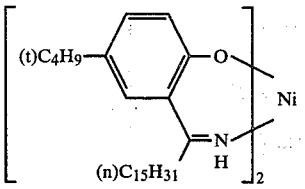
I-21
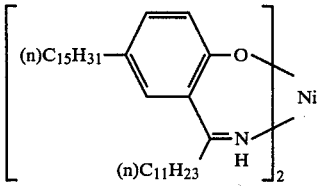
I-22
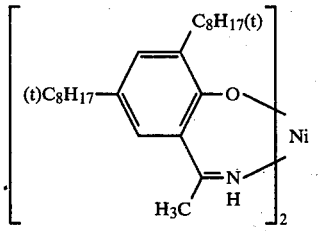
I-23
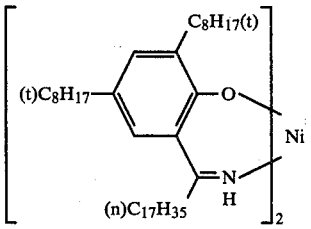
I-24
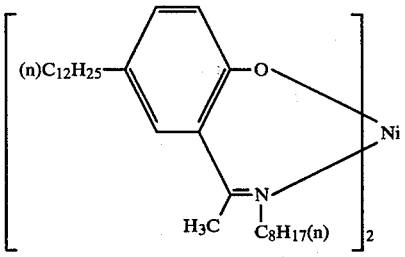
I-25
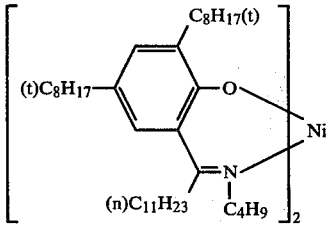
-continued
I-26
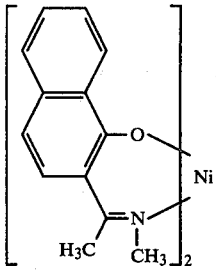
I-27
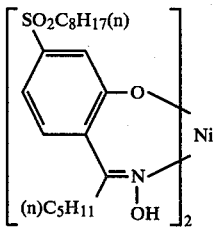
I-28
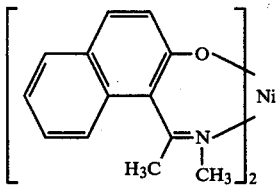
I-29
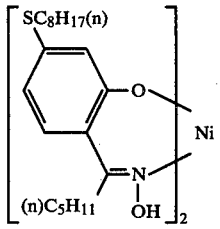
I-30
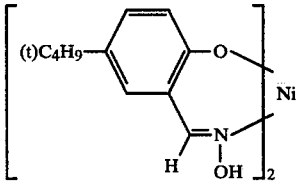
I-31
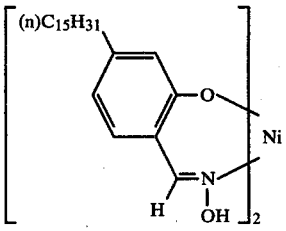
I-32
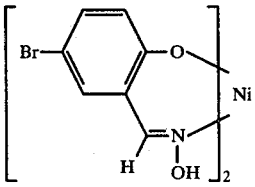

-continued
I-33
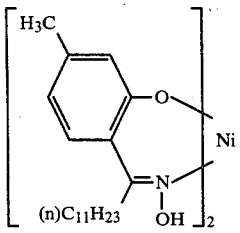
I-34
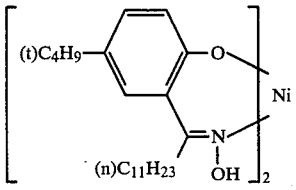
I-35
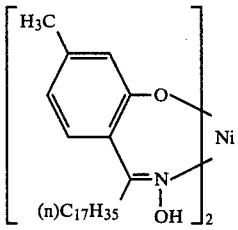
I-36
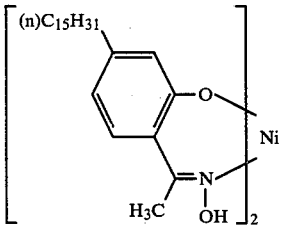
I-37
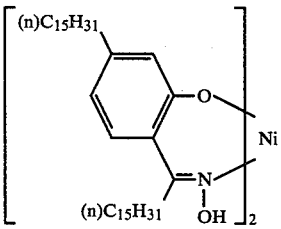
I-38
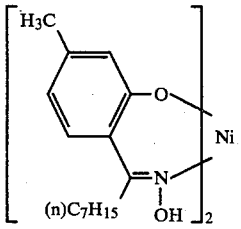
I-39
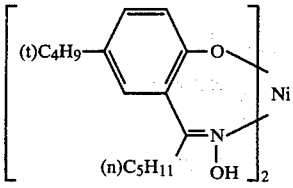
-continued
I-40
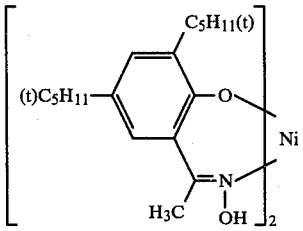
I-41
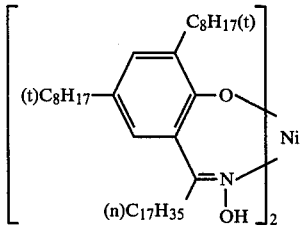
I-42
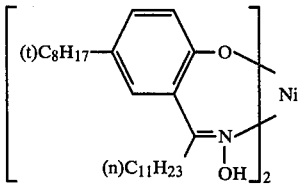
I-43
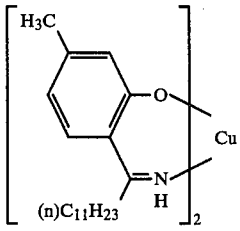
I-44
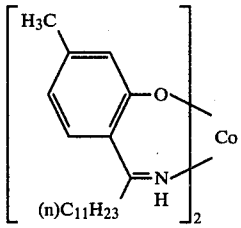
I-45
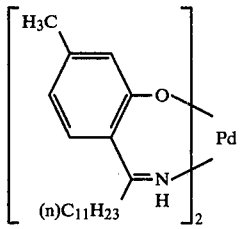
I-46
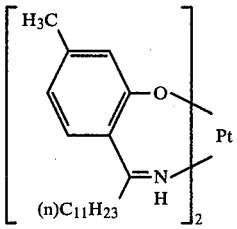

-continued
I-47
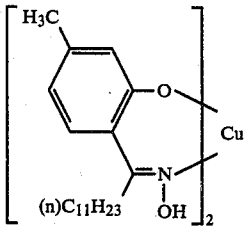
I-48
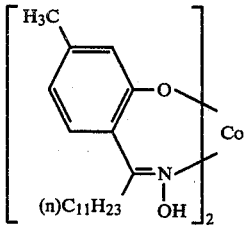
I-49
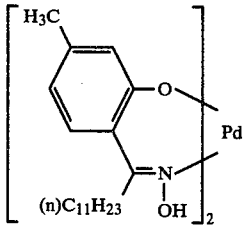
I-50
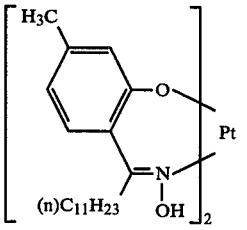
I-51
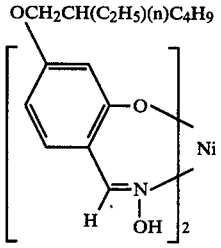
I-52
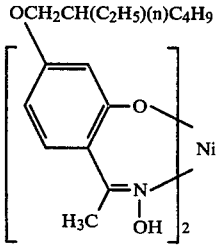
-continued
I-53
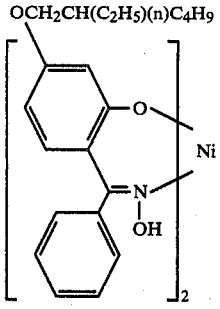
I-54
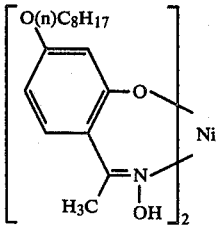
I-55
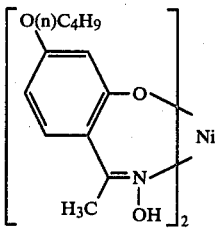
I-56
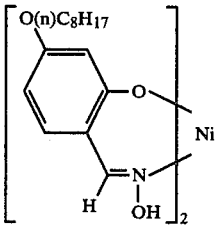
I-57
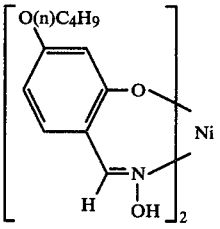
I-58
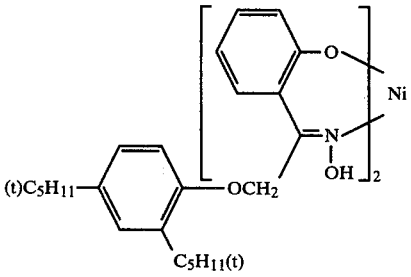

-continued
I-59
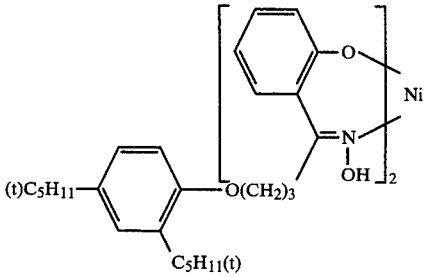
I-60
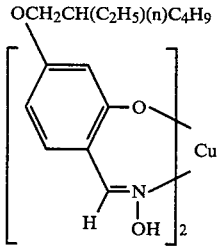
I-61
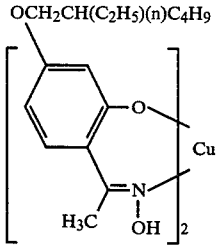
I-62
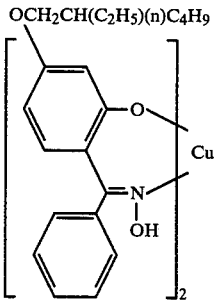
I-63
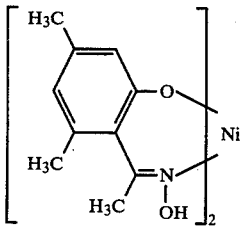
I-64
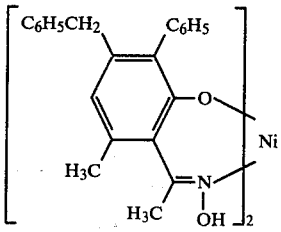
-continued
I-65
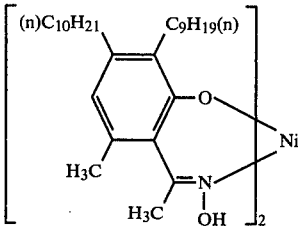
I-66
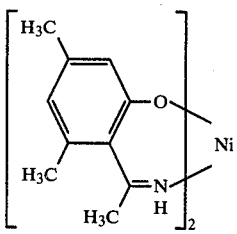
I-67
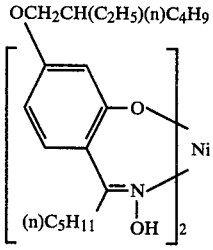
I-68
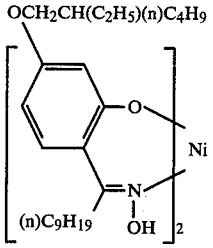
I-69
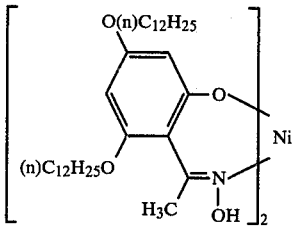
I-70
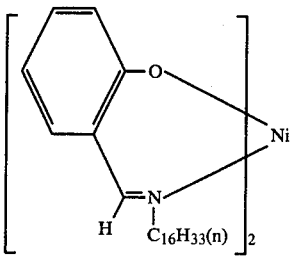

-continued
I-71
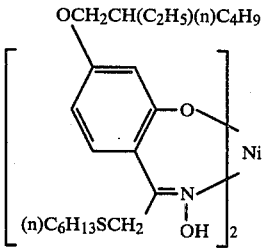
I-72
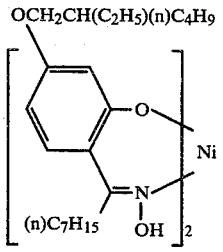
I-73
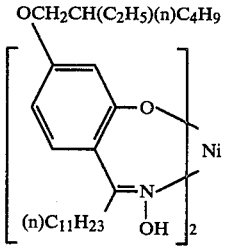
I-74
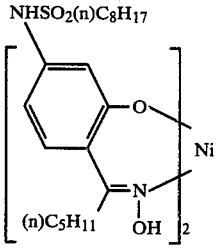
I-75
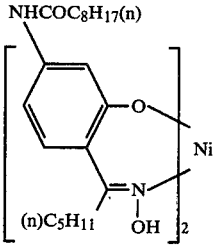
I-76
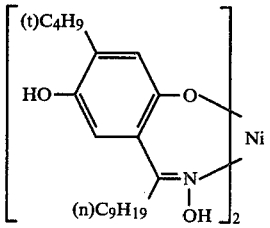
-continued
I-77
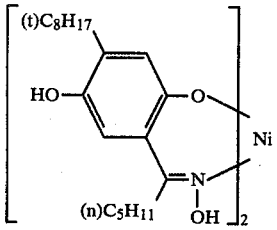
I-78
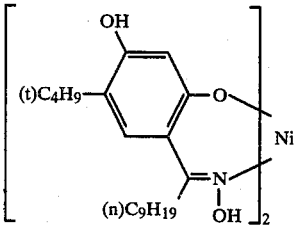
I-79
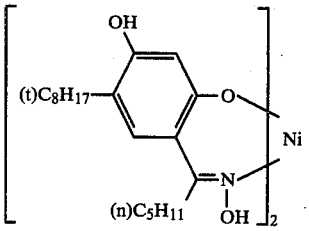
I-80
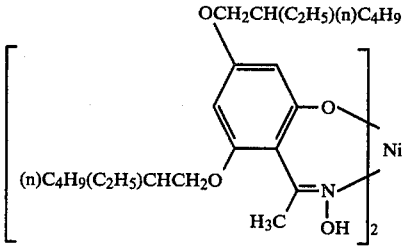
II-1
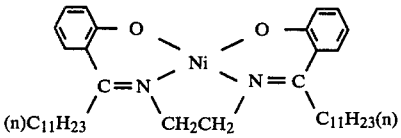
II-2
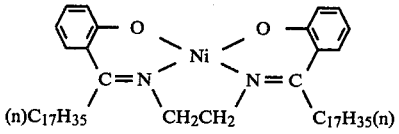
II-3
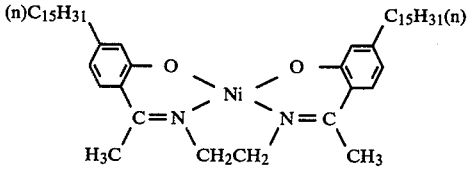
II-4
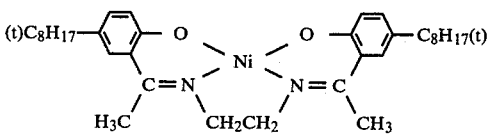

-continued
II-5
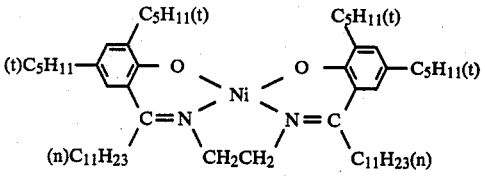
II-6
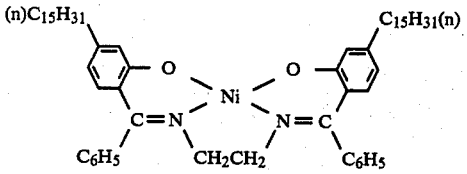
II-7
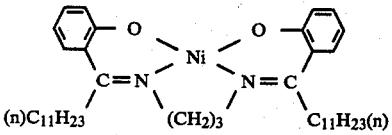
II-8
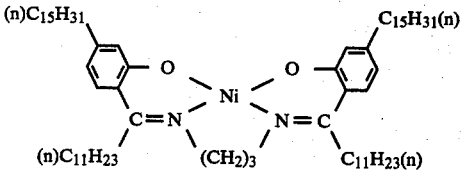
II-9
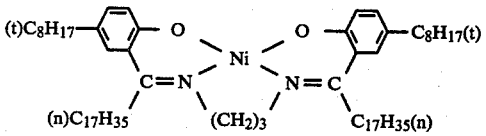
II-10
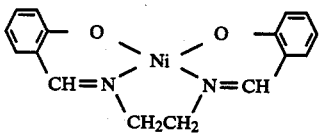
II-11
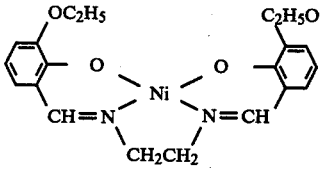
II-12
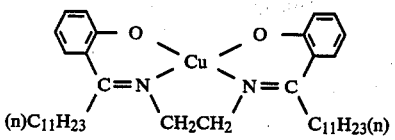
II-13
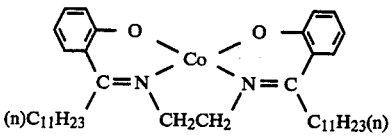
II-14
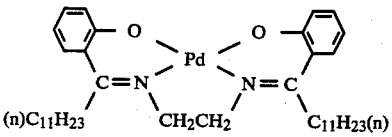
-continued
II-15
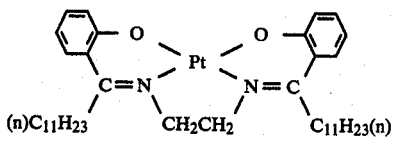
II-16
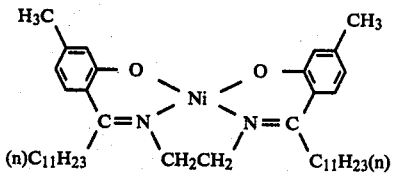
II-17
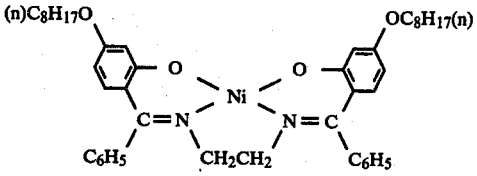
II-18
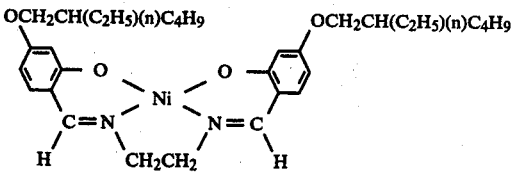
II-19
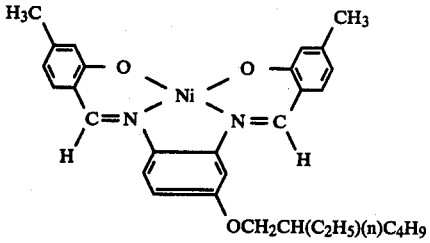
II-20
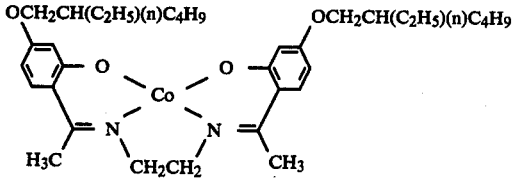
II-21
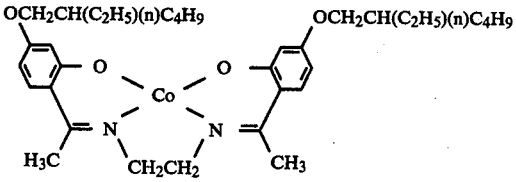
III-1
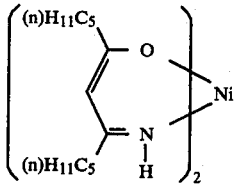

-continued
III-2
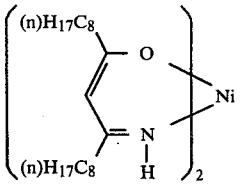
III-3
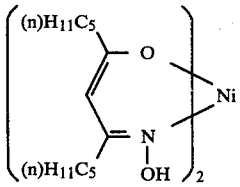
III-4
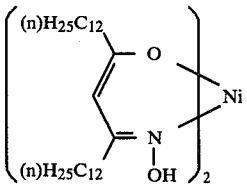
III-5
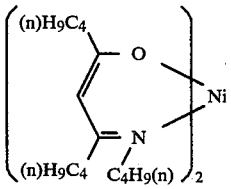
III-6
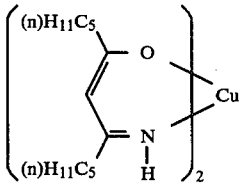
III-7
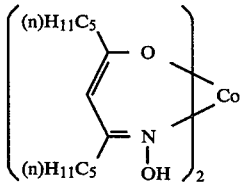
III-8
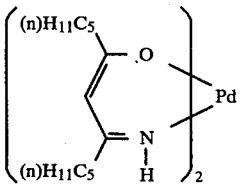
III-9
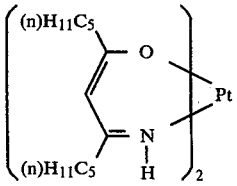
-continued
III-10
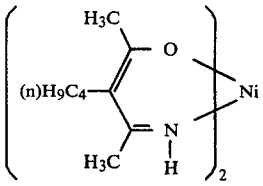
III-11
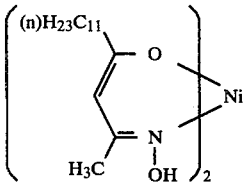
III-12
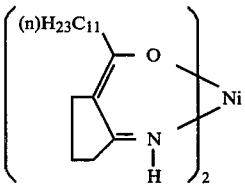
III-13
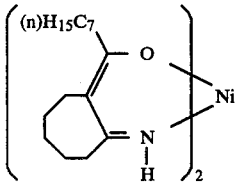
IV-1
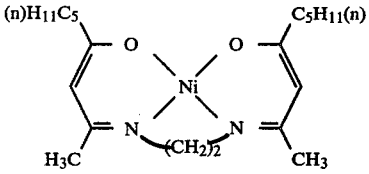
IV-2
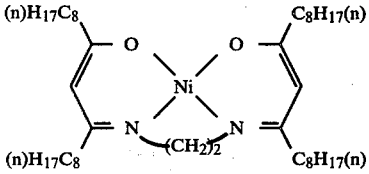
IV-3
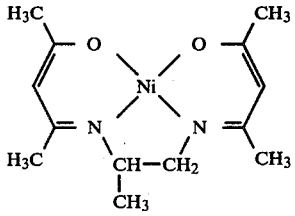
IV-4
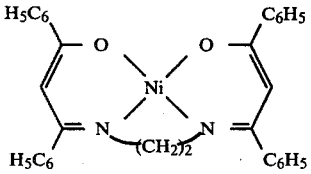

-continued

IV-5

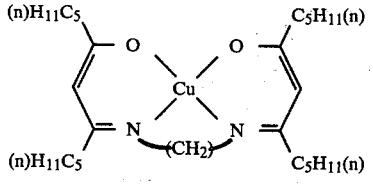

IV-6

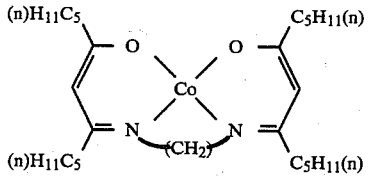

IV-7

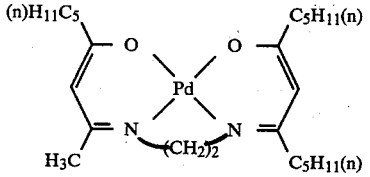

IV-8

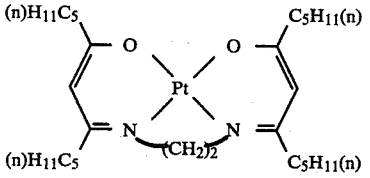

IV-9

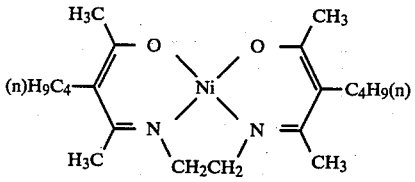

IV-10

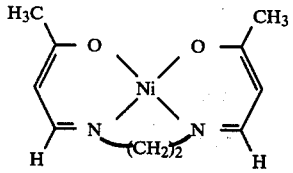

IV-11

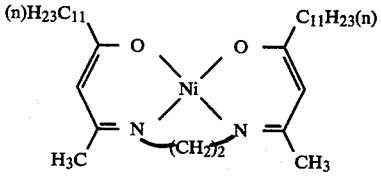

IV-12

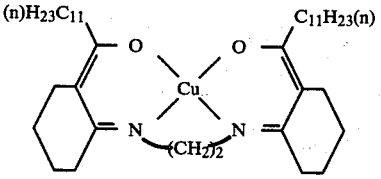

IV-13

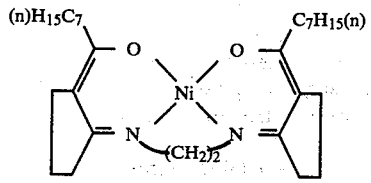

-continued

IV-14

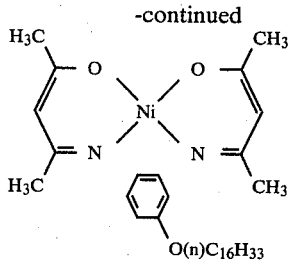

The above-described complexes can be synthesized by the methods as described, for example, in R. H. Holm, G. W. Everett, A. Chakravorty, *Metal Complexes of Schiff Bases and β-Ketoamines, Progr. Inorg. Chem.*, 783 (1966), L. Sacconi, *Coord. Chem. Rev.*, 1, 126 (1966) and S. Yamada, ibid., 1, 415 (1966).

Hereinafter examples to illustrate the preparation of such complexes are provided.

SYNTHESIS EXAMPLE 1

Preparation of Compound I-1

2 g of sodium hydroxide was dissolved in 130 ml of methanol. 14.5 g of 2-lauroyl-5-methylphenol was added to the methanol solution prepared above and completely dissolved therein. This solution was gradually added to an aqueous solution prepared by dissolving 12 g of nickel chloride-6 hydrate in 100 ml of water. A light green precipitate deposited. This precipitate was filtered, washed with water and dried with air. This precipitate was a compound represented by the following formula:

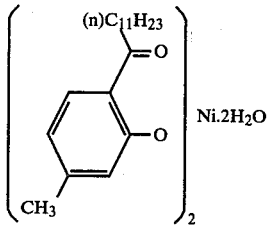

To 5 g of the dried nickel complex as obtained above was added 100 ml of concentrated ammonia water, and on stirring the resulting mixture at room temperature for 72 hours, a reddish brown precipitate was obtained. This precipitate was filtered off and washed with water. After drying with air, it was recrystallized from benzene. Thus 3 g of red crystals were obtained. The melting point was 151° C. to 153° C.

| | Elemental Analysis: | | |
|---|---|---|---|
| | H | C | N |
| Calc'd (%): | 9.53 | 71.79 | 4.41 |
| Found (%): | 9.30 | 71.90 | 4.18 |

SYNTHESIS EXAMPLE 2

Preparation of Compound I-33

3.06 g of 2-hydroxy-4-methylphenylundecylketoxime, which was obtained by reacting 2-lauroyl-5-methylphenol and a hydroxyamine-sulfuric acid salt by a conventional procedure, was dissolved in 26 ml of ethanol and refluxed. To the resulting solution was dropwise added a solution prepared by dissolving 1.10 g of nickel chloride-6 hydrate in 7 ml of ethanol. After the dropwise addition was completed, the solution was concentrated to obtain a dark green solid. This solid was recrystallized from benzene. Thus, 2.4 g of fine crystals of Compound I-33 was obtained. The melting point was 104° C. to 105° C.

| | Elemental Analysis: | | |
|---|---|---|---|
| | H | C | N |
| Calc'd (%): | 9.08 | 68.35 | 4.20 |
| Found (%): | 8.97 | 68.01 | 4.45 |

SYNTHESIS EXAMPLE 3

Preparation of Compound I-60

10.6 g of 2-hydroxy-4-(2-ethylhexyloxy)benzaldoxime, which was obtained by reacting 2-hydroxy-4-(2-ethylhexyloxy)benzaldehyde and hydroxyamine-sulfuric acid salt by a conventional procedure, was dissolved in 30 ml of ethanol. The solution so obtained was added to a solution prepared by dissolving 5.6 g of copper acetatemonohydrate in 200 ml of water, and on stirring the resulting solution at room temperature for 2 hours, a brown precipitate was obtained. This precipitate was filtered off and washed with water. After drying with air, the precipitate was recrystallized from n-hexane. Thus 7 g of brown crystals were obtained. The melting point was 138° C. to 139° C.

| | Elemental Analysis: | | |
|---|---|---|---|
| | H | C | N |
| Calc'd (%): | 7.49 | 60.84 | 4.73 |
| Found (%): | 7.55 | 60.91 | 5.00 |

SYNTHESIS EXAMPLE 4

Preparation of Compound I-67

19.2 g of 2'-hydroxy-4'-(2-ethylhexyloxy)-hexaphenone, which was obtained by reacting 2',4'-dihydroxyhexaphenone and 2-ethylhexybromide by the usual method, was dissolved in 120 ml of ethanol. The solution so obtained was added to a solution prepared by dissolving 12 g of sodium hydroxide and 9.8 g of a hydroxyaminesulfuric acid salt in 120 ml of water, and the resulting mixture was refluxed while heating. After 1 hour, 500 ml of cold water containing 10 ml of acetic acid was added, and extraction was conducted with 300 ml of ethyl acetate. The ethyl acetate layer was washed twice with 300 ml of water. Thereafter, on distilling off the ethyl acetate under reduced pressure, a brown oily product was obtained. This oily product was dissolved in 150 ml of ethanol and then added to a solution which was prepared by dissolving 12.5 of nickel acetate-4 hydrate in 150 ml of water. On stirring the mixture at room temperature for 2 hours, a light green precipitate was obtained. This precipitate was filtered off and washed with water. After air-drying, the precipitate was recrystallized from 100 ml of a mixture of n-hexane:ethanol = 1:3 (by volume), and thus 21 g of crystals of the desired product, i.e., light green Compound I-67 was obtained. The melting point was 72° C. to 73° C.

| | Elemental Analysis: | | |
|---|---|---|---|
| | H | C | N |
| Calc'd (%): | 8.87 | 66.02 | 3.85 |
| Found (%): | 9.01 | 66.01 | 4.13 |

SYNTHESIS EXAMPLE 5

Preparation of Compound II-16

6 g of N,N'-bis(2-hydroxy-4-methyllaurophenon)-diimine, which was prepared by reacting 2-lauroyl-5-methylphenol and ethylenediamine by the usual method, was dissolved in 50 ml of methanol and refluxed. To the solution so prepared was added dropwise gradually a solution prepared by dissolving 2.5 g of nickel acetate-4 hydrate in 25 ml of methanol. On refluxing the mixture for 1 hour, reddish brown crystals were obtained. These crystals were filtered off and recrystallized from acetone. Thus, 4.3 g of reddish brown crystals were obtained. The melting point was 105° C. to 107° C.

| | Elemental Analysis: | | |
|---|---|---|---|
| | H | C | N |
| Calc'd (%): | 9.45 | 72.61 | 4.23 |
| Found (%): | 9.49 | 72.58 | 4.42 |

The term "discoloration prevention aid" is used herein to refer to a compound that exhibits a discoloration prevention effect in combination with the complex, whereas the discoloration prevention effect of the compound per se is not sufficient.

The organic compound having the aromatic nucleus which is used in this invention to aid in the prevention of discoloration is represented by formula (V), (VI), or (VII), as described below.

Formula (V) is

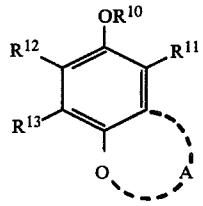

(V)

wherein $R^{10}$ is hydrogen, an alkyl group containing from 1 to 22 carbon atoms (e.g., methyl, ethyl, propyl, n-octyl, dodecyl, hexadecyl, etc.), an acyl group (e.g., acetyl, benzoyl, hentanoyl, (2,4-di-tert-amylphenoxy)acetyl, etc.), a sulfonyl group (e.g., methanesulfonyl, butanesulfonyl, benzenesulfonyl, toluenesulfonyl, hexadecanesulfonyl, etc.), a carbamoyl group (e.g., N-methylcarbamoyl, N,N-diethylcarbamoyl, N-dodecylcarbamoyl, N-phenylcarbamoyl, etc.), a sulfamoyl group (e.g., N-methylsulfamoyl, N,N-dimethylsulfamoyl, N-tetradecylsulfamoyl, N-phenylsulfamoyl, etc.), an alkoxycarbonyl group (e.g., methoxycarbonyl, ethoxycarbonyl, benzyloxycarbonyl, phenoxycarbonyl, etc.), a trialkylsilyl group (e.g., trimethylsilyl, dimethylbutylsilyl, etc.);

A is a group of non-metallic atoms forming a 5- or 6-membered ring in combination with

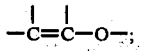

the 5- or 6-membered ring may be substituted with an alkyl group (e.g., methyl, tert-butyl, cyclohexyl, octyl, dodecyl, octadecyl, etc.), an alkoxy group (e.g., methoxy, butoxy, dodecyloxy, etc.), an aryl group (e.g., phenyl, etc.), an aryloxy group (e.g., phenoxy, etc.), an aralkyl group (e.g., benzyl, phenetyl, etc.), an aralkoxy group (e.g., benzyloxy, phenetyloxy, etc.), an alkenyl group (e.g., allyl, etc.), an N-substituted amino group (e.g., alkylamino, dialkylamino, N-alkyl-N-arylamino, piperazino, etc.), a heterocyclic group (e.g., benzothiazolyl, benzoxazoyl, etc.), etc., or by a radical forming a condensed ring; and the above alkyl group and aryl group may be substituted with a halogen atom, a hydroxy group, a carboxy group, an alkoxycarbonyl group, an acyloxy group, a sulfo group, a sulfonyloxy group, an amido group (e.g., acetamido, ethanesulfonamido, benzamido, etc.), an alkoxy group, an aryloxy group, etc.;

$R^{11}$, $R^{12}$, and $R^{13}$ are each hydrogen, an alkyl group (e.g., methyl, tert-butyl, cyclopentyl, n-octyl, tert-octyl, dodecyl, octadecyl, etc.), an alkoxy group (e.g., methoxy, butoxy, dodecyloxy, etc.), an aryl group (e.g., phenyl, etc.), an aryloxy group (e.g., phenoxy, etc.), an aralkyl group (e.g., benzyl, phenetyl, etc.), an aralkoxy group (e.g., benzyloxy, phenetyloxy, etc.), an alkenyl group (e.g., allyl, etc.), an alkenoxy group (e.g., aryloxy, etc.), an acylamino group (e.g., acetylamino, benzamido, (2,4-di-tert-amylphenoxy)acetylamino, (etc.), a halogen atom (e.g., chlorine, bromine, etc.), an alkylthio group (e.g., ethylthio, dodecylthio, octadecylthio, etc.), a diacylamino group (e.g., succinimido, hydantoinyl, etc.), an arylthio group (e.g., phenylthio, etc.), an alkoxycarbonyl group (e.g., methoxycarbonyl, ethoxycarbonyl, benzyloxycarbonyl, etc.), an acyloxy group (e.g., acetyloxy, benzoyloxy, etc.), an acyl group (e.g., methylcarbonyl, etc.), or a sulfonamido group. They may be the same or different.

The compounds represented by formula (V) can comprise a 5- or 6-membered bisspiro compound containing A. SUch bisspiro compounds which are useful in this invention are represented by formula (V')

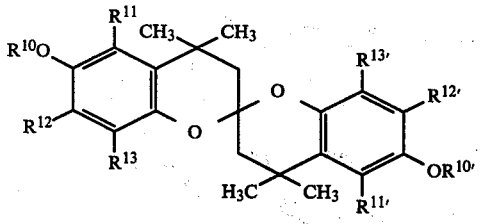

(V')

$R^{10}$, $R^{11}$, $R^{12}$, $R^{13}$, $R^{10'}$, $R^{11'}$, $R^{12'}$, and $R^{13'}$ in formula (V') have the same meanings as $R^{10}$, $R^{11}$, $R^{12}$, and $R^{13}$ in formula (V).

Those represented by formula (V) wherein the total number of carbon atoms contained in $R^{11}$, $R^{12}$, $R^{13}$ is at least 8, and those represented by formula (V') are low in diffusion properties, and therefore they are suitable to be selectively incorporated in a specific hydrophilic layer of the light-sensitive element. 5-hydroxycumaranes and 6-hydroxychromans according to formula (V) wherein the total number of carbon atoms contained in the molecule is up to about 40 and one of $R^{11}$ and $R^{12}$ is hydrogen, and 6,6'-dihydroxy-bis-2,2'-spirochromans represented by formula (V') are particularly useful. More preferred are those represented by formulae (V) and (V') wherein $R^{11}$, $R^{12}$, $R^{13}$, $R^{11'}$, $R^{12'}$, and $R^{13'}$ are each selected from an alkyl group, an alkoxy group, an aryl group, an aryloxy group or an alkylthio group.

Formula (VI) is

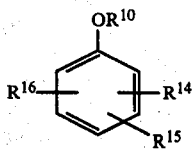

(VI)

wherein $R^{10}$ has the same meaning as defined in formula (V);

$R^{14}$ is a straight chain or branched chain alkyl group containing from 1 to 22 carbon atoms (e.g., methyl, tert-butyl, n-octyl, tert-octyl, dodecyl, hexadisyl, etc.), an alkoxy group containing from 1 to 22 carbon atoms (e.g., methoxy, ethoxy, octyloxy, tetradecyloxy, etc.), an arylthio group (e.g., phenylthio, etc.), an arylsulfinyl group (e.g., phenylsulfinyl, etc.), an arylsulfonyl group (e.g., phenylsulfonyl, etc.), an aralkyl group (e.g., benzyl, phenetyl, etc.), a halogen atom (e.g., chlorine, bromine, etc.), an aryl group (e.g., phenyl, α- or β-naphthyl, etc.), or an acyl group (e.g., acetyl, butanoyl, benzoyl, etc.);

$R^{15}$ is hydrogen, an alkyl group containing from 1 to 22 carbon atoms (e.g., methyl, ethyl, tert-butyl, tert-octyl, n-dodecyl, n-hexadecyl, etc.), an alkoxy group containing from 1 to 22 carbon atoms (e.g., methoxy, n-butyloxy, n-octyloxy, n-tetradecyloxy, 2-ethylhexyloxy, etc., but $R^{10}O$- and $R^{15}$ cannot be the same substituent), an aralkyloxy group containing from 7 to 22 carbon atoms (e.g., benzoyloxy, β-phenethyloxy, etc., but $R^{10}O$- and $R^{15}$ cannot be the same substituent), an alkylthio group containing from 1 to 22 carbon atoms (e.g., methylthio, octylthio, dodecylthio, hexadecylthio, etc.), an aralkylthio group (e.g., benzylthio, β-phenoxythio, etc.), an acylamino group containing from 2 to 22 carbon atoms (e.g., acetylamino, benzoamido, etc.), an acyl group containing from 2 to 22 carbon atoms (e.g., acetyl, butanoyl, benzoyl, etc.), an alkylamino group containing from 1 to 22 carbon atoms (e.g., methylamino, ethylamino, N,N-dimethylamino, N-methyl-N-dodecylamino, etc.), an arylamino group containing from 6 to 22 carbon atoms (e.g., phenylamino, N-phenyl-N-methylamino, β-naphthylamino, etc.), or a heterocyclic amino group (e.g.,

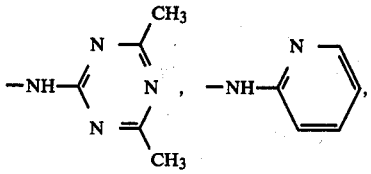

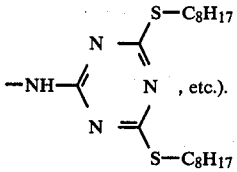

, etc.).

$R^{16}$ is hydrogen, a halogen atom (e.g., chlorine, bromine, etc.), an alkyl group containing from 1 to 22 carbon atoms (e.g., methyl, ethyl, tert-butyl, tert-octyl, tert-amyl, tert-hexyl, n-hexadecyl, etc.), an arylthio group containing from 6 to 22 carbon atoms (e.g., phenylthio, etc.), an alkylthio group containing from 1 to 22 carbon atoms (e.g., methylthio, octylthio, dodecylthio, octadecylthio, etc.), an arylsulfonyl group containing from 6 to 22 carbon atoms (e.g., phenylsulfonyl, etc.), an arylsulfinyl group containing from 6 to 22 carbon atoms (e.g., phenylsulfinyl, etc.), an aralkyl group containing from 7 to 32 carbon atoms (e.g., benzyl, α- or β-phenethyl, etc.), an aryl group containing from 6 to 32 carbon atoms (e.g., phenyl, α- or β-naphthyl, etc.), an aryldithio group containing from 6 to 32 carbon atoms, or an aryloxy group containing from 6 to 32 carbon atoms.

Formula (VII) is

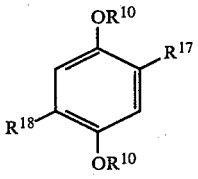

(VII)

wherein $R^{17}$ is hydrogen, a straight chain or branched chain alkyl group containing from 1 to 22 carbon atoms (e.g, methyl, ethyl, tert-butyl, tert-octyl, isopropyl, tert-pentyl, tert-hexyl, n-octadecyl, 3-methyl-3-pentyl, 3-ethyl-3-pentyl, etc.), or an alkenyl group containing from 3 to 22 carbon atoms (e.g., allyl, 1-tert-butyl-1-allyl, etc.);

$R^{18}$ is a straight chain or branched chain alkyl group containing 1 to 22 carbon atoms (e.g., methyl, ethyl, tert-butyl, tert-octyl, isopropyl, tert-pentyl, tert-hexyl, n-octadecyl, 3-methyl-3-pentyl, 3-ethyl-3-pentyl, etc.), or an alkenyl group containing from 3 to 22 carbon atoms (e.g., allyl, 1-tert-butyl-1-allyl, etc.);

$R^{17}$ and $R^{18}$ may be either the same or different; and $R^{10}$ is the same as $R^{10}$ in formula (V).

Representative examples of the aromatic ring-containing organic compounds represented by formulae (V) to (VII) which are used to aid the prevention of discoloration in this invention are shown below, but this invention is not limited thereto.

V-1

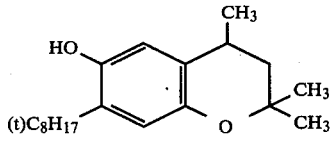

V-2

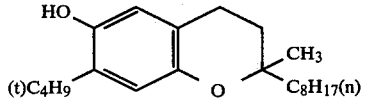

V-3

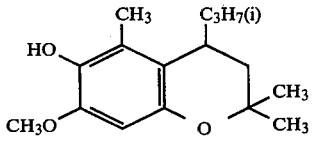

-continued

V-4

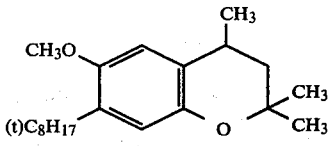

V-5

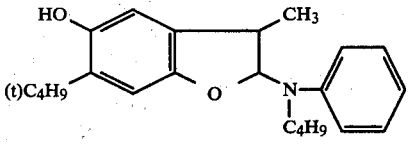

V-6

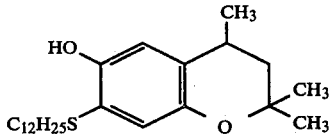

V-7

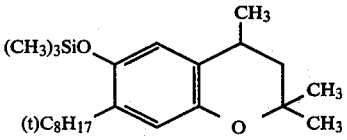

V-8

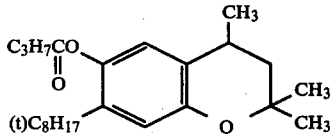

V-9

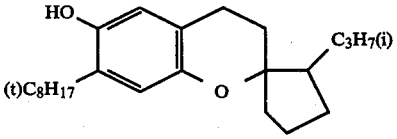

V-10

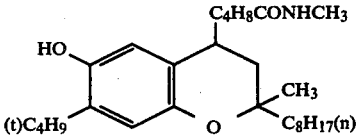

V-11

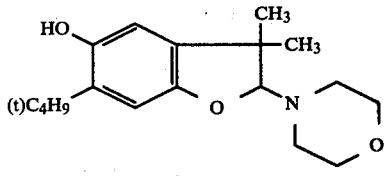

V-12

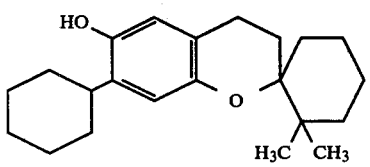

V'-1

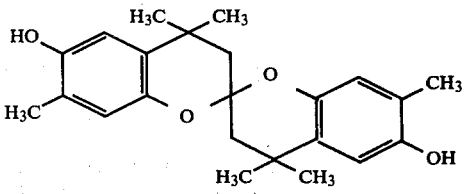

-continued
V'-2
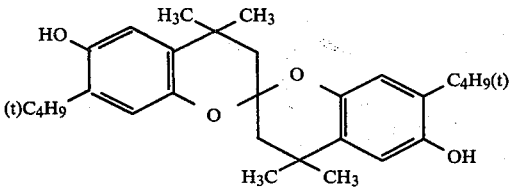
V'-3
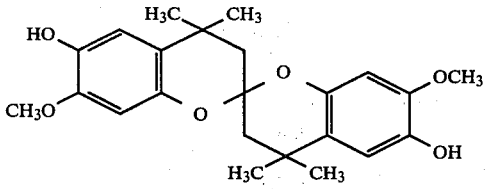
V'-4
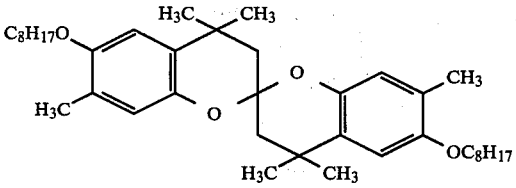
V'-5
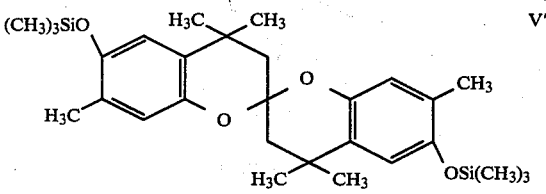
V'-6
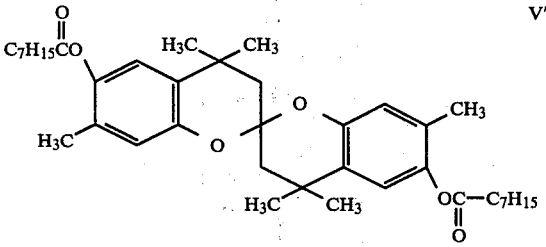
V'-7
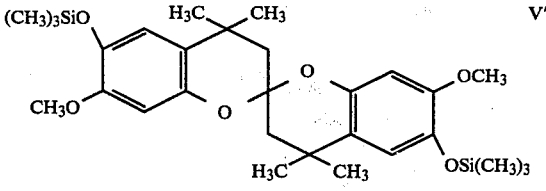
V'-8
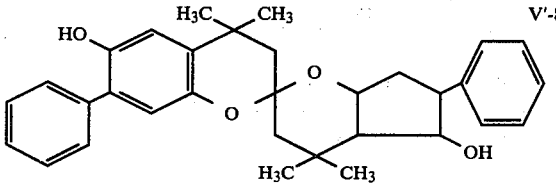
VI-1
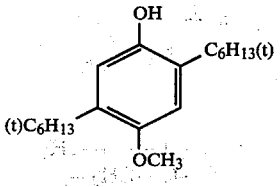
-continued
VI-2
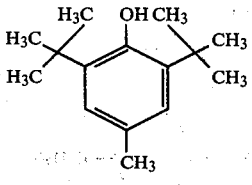
VI-3
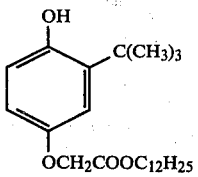
VI-4
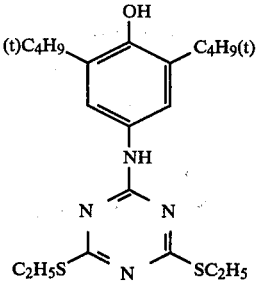
VI-5
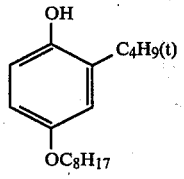
VI-6
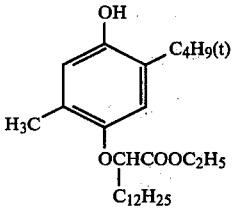
VI-7
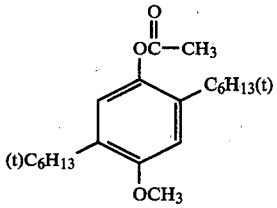
VI-8
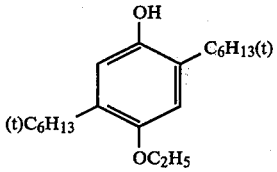
VI-9
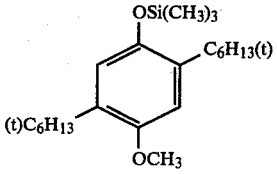

-continued
VI-10
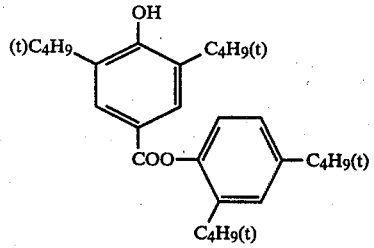
VI-11
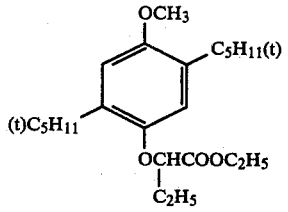
VII-1
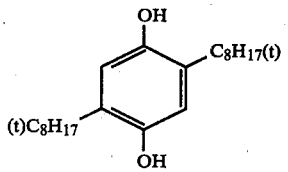
VII-2
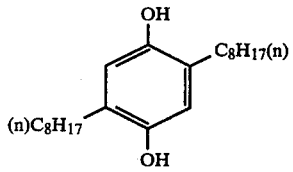
VII-3
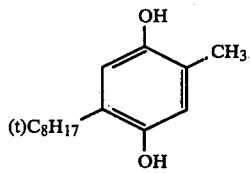
VII-4
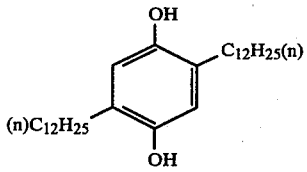
VII-5
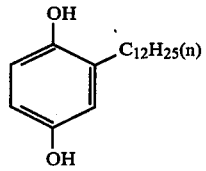
VII-6
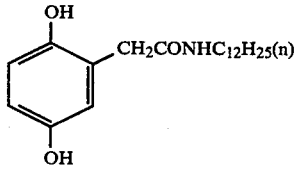
-continued
VII-7
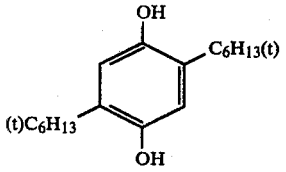
VII-8
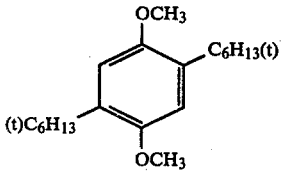
VII-9
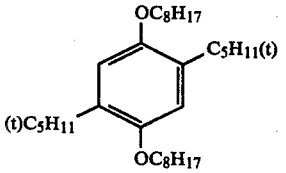
VII-10
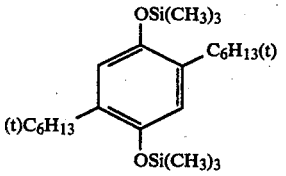
VII-11
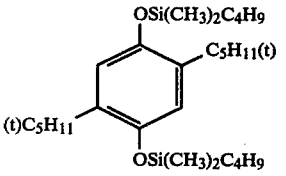
VII-12
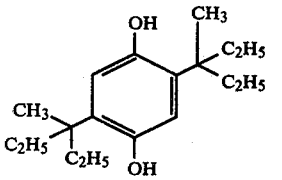
VII-13
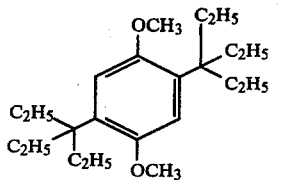
Of the compounds represented by formula (VI), those compounds represented by formula (VIII) are preferred for purposes of the present invention.
(VIII)
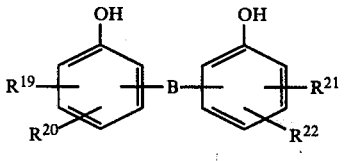
wherein
B is —S—, —S—S—, —O—, —$CH_2$—S—$CH_2$—, —$SO_2$—, —SO—, —$CH_2$—O—$CH_2$—,

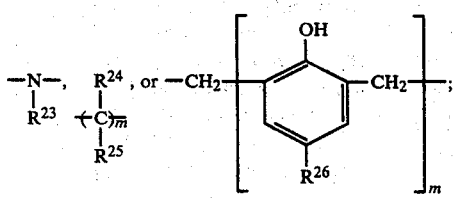

$R^{19}$, $R^{20}$, $R^{21}$, and $R^{22}$ are each hydrogen, or an alkyl group, an aryl group, an aralkyl group, an alkylthio group, a halogen atom, an alkoxy group, an arylthio group, an aralkoxy group, an aryloxy group, $-COOR^{27}$, $-NHCOR^{27}$, $-NHSO_2R^{27}$, $-SO_2R^{27}$, $-O-COR^{27}$,

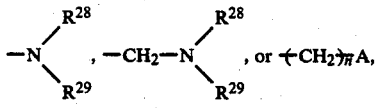

all containing from 1 to 22 carbon atoms; and $R^{23}$ is hydrogen, an alkyl group or an aryl group; $R^{24}$ and $R^{25}$ are each hydrogen, or an aryl group, or they combine together to form a substituted 5- or 6-membered ring; $R^{26}$ is hydrogen or a methyl group; $R^{27}$ is an alkyl group or an aryl group; $R^{28}$ and $R^{29}$ are each hydrogen, an alkyl group, an aryl group, a heterocyclic group or a aralkyl group, or they combine together to form a substituted 5- or 6-membered heterocyclic ring; A is an ester group or

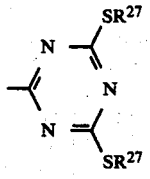

and m and n are each integer of 1 to 3.

Examples thereof include the following compounds:

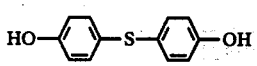
VIII-1

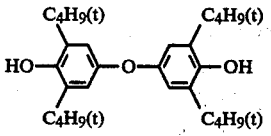
VIII-2

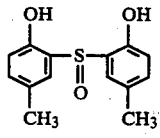
VIII-3

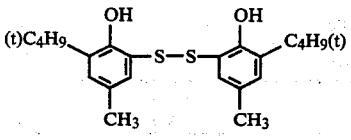
VIII-4

-continued

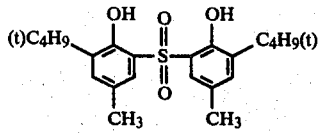
VIII-5

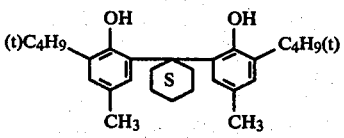
VIII-6

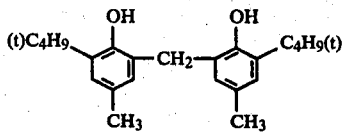
VIII-7

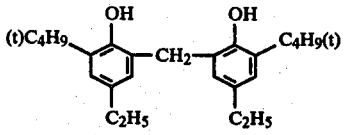
VIII-8

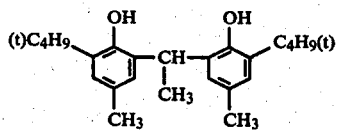
VIII-9

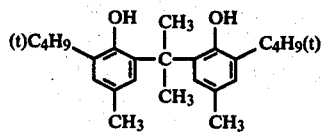
VIII-10

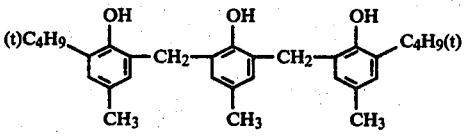
VIII-11

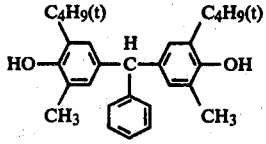
VIII-12

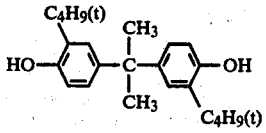
VIII-13

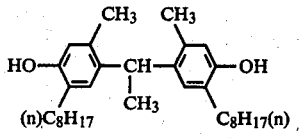
VIII-14

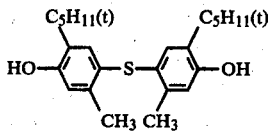
VIII-15

-continued

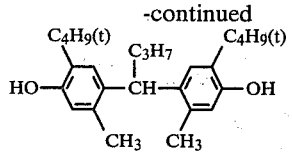

VIII-16

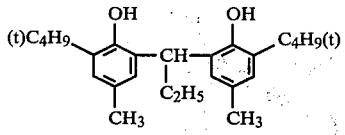

VIII-17

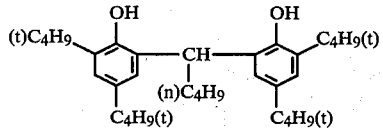

VIII-18

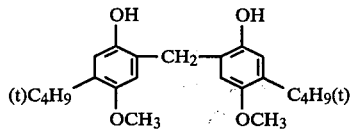

VIII-19

In the practice of this invention, when 3-anilino-5-pyrazolone couplers represented by formula (IX) or (X) are used singly or in admixtures comprising two or more thereof, complexes represented by formula (I), (II), (III) or (IV) may be used alone or a mixture of two or more of compounds having the same structure.

Additionally, chroman compounds represented by formula (V), phenol derivatives represented by formula (VI), or hydroquinone derivatives represented by formula (VII) may be used singly or in combination with each other. Furthermore, discoloration preventing agents and anti-oxidants other than those represented by formulae (I) to (VII) can be used together therewith.

Known discoloration preventing agents include hydroquinone derivatives as described in U.S. Pat. Nos. 2,360,290, 2,418,613, 2,675,314, 2,701,197, 2,704,713, 2,728,659, 2,732,300, 2,735,765, 2,710,801, 2,816,028, British Patent 1,363,921, etc., gallic acid derivatives as described in U.S. Pat. Nos. 3,457,079, 3,069,262, etc., p-alkoxyphenols as described in U.S. Pat. Nos. 2,735,765, 3,698,909, Japanese Patent Publication Nos. 20977/74, 6623/77, etc., p-oxyphenols as described in U.S. Pat. Nos. 3,432,300, 3,573,050, 3,574,627, 3,764,337, Japanese Patent Application (OPI) Nos. 35633/77, 14743/77, 152225/77, etc., and so on.

The complexes of formulae (I) to (IV) as used in this invention can be used alone or in combination with each other. The suitable amount of the complex added is usually from about 0.01 mol to 10 mols per mol of the magenta coupler. A range of from about 0.05 mol to 2 mols per mol of the magenta coupler is particularly preferred.

The suitable amount of the discoloration prevention aid of formulae (V) to (VIII) used is usually from about 0.01 to about 10 mols per mole of the magenta coupler. The range of about 0.1 mol to about 5 mols per mol of the magenta coupler is particularly preferred.

The introduction of the coupler and discoloration preventing agent of this invention into the silver halide emulsion layer can be achieved by known methods, for example, the method as described in U.S. Pat. No. 2,322,027 can be employed. For example, they are dissolved in phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetyl citrate, etc.), benzoic acid esters (e.g., octyl benzoate, etc.), alkylamides (e.g., diethyllaurylamide, etc.), aliphatic acid esters (e.g., dibutoxyethyl succinate, dioctyl azelate, etc.), or the like, or in organic solvents having a boiling point of about 30° C. to about 150° C., such as lower alkyl acetate, e.g., ethyl acetate and butyl acetate, ethyl propionate, sec-butyl alcohol, methyl isobutyl ketone, β-ethoxyethyl acetate, methyl cellosolve acetate, etc., and then are dispersed in hydrophilic colloids. The above high boiling point organic solvent and low boiling point organic solvent may be used in combination with each other.

Additionally, a dispersion process using polymers as described in Japanese Patent Publication No. 39853/76 and Japanese Patent Application (OPI) No. 59943/76 can be used.

Where the coupler contains an acid group, such as carboxylic acid and sulfonic acid, it is introduced into the hydrophilic colloid as an alkaline aqueous solution.

The following examples and comparative examples are provided to illustrate this invention in greater detail.

EXAMPLE 1

10 g of 3-anilino-5-pyrazolone magenta coupler (1) of this invention was dissolved in a mixture of 10 ml of tricresyl phosphate and 20 ml of ethyl acetate, the compounds as indicated in Table 1 were added, and the solution so obtained was emulsified and dispersed in 80 g of a 10% gelatin solution containing 8 ml of 1% sodium dodecylbenzenesulfonate.

This dispersion was mixed with 145 g (7 g as silver) of a green sensitive silver chlorobromide emulsion (Br 50 mol%), and sodium dodecylbenzenesulfonate was added thereto as an auxiliary coating agent. The mixture thus prepared was coated on a paper support with polyethylene laminated on both the sides thereof (the amount of the coupler coated was 400 mg/m$^2$). Furthermore, a gelatin protective layer (1 g/m$^2$) was provided thereon and dried. This was designated as Sample I-A.

In the same manner as above, Samples I-B to I-Q as shown in Table 1 were prepared.

These samples were exposed to light at 1,000 lux/sec with a sensitometer, and developed with the following developer.

| Composition of Color Developer | |
|---|---|
| Benzyl Alcohol | 15 ml |
| Diethylene Glycol | 8 ml |
| Ethylenediaminetetraacetate | 5 g |
| Sodium Sulfite | 2 g |
| Anhydrous Potassium Carbonate | 30 g |
| Hydroxylamine Sulfuric Acid Salt | 3 g |
| Potassium Bromide | 0.6 g |
| 4-Amino-N-ethyl-N-(β-methanesulfonamidoethyl)-m-toluidine ⅔ Sulfuric Acid Salt Monohydrate | 5 g |
| Adjusted pH to 10.20 | |
| Water to make | 1 l |
| **Composition of Bleach-Fixer** | |
| Ethylenediaminetetraacetate | 2 g |
| Ethylenediaminetetraacetate Iron (III) Salt | 40 g |
| Sodium Sulfite | 5 g |
| Ammonium Thiosulfate | 70 g |
| Water to make | 1 l |

| Processing | Temperature (°C.) | Time (minutes) |
|---|---|---|
| 1. Color Development | 33 | 3.5 |

-continued

| | | |
|---|---|---|
| 2. Bleach-Fixing | 33 | 1.5 |
| 3. Water Washing | 25 to 30 | 2.5 |

TABLE 1

| Sample | Coupler | Compound Added | | Change in Yellow Color Density in White Area | Change in Magenta Density (density prior to testing, 1.0) | Remarks |
|---|---|---|---|---|---|---|
| I-A | (1) 10 g | — | | +0.25 | −0.82 | Comparative Example |
| I-B | " | (I-72) | 2 g | +0.23 | −0.25 | " |
| I-C | " | (V'-1) | 1 g | +0.26 | −0.50 | " |
| I-D | " | (VI-1) | 1 g | +0.24 | −0.54 | " |
| I-E | " | (VII-1) | 1 g | +0.23 | −0.57 | " |
| I-F | " | (V-7) | 1 g | +0.20 | −0.42 | " |
| | | (VII-1) | 1 g | | | |
| I-G | " | (VII-1) | 1 g | +0.21 | −0.40 | " |
| | | (VII-8) | 1 g | | | |
| I-H | " | (I-67) | 2 g | +0.25 | −0.24 | " |
| I-I | " | (VIII-7) | 1 g | +0.15 | −0.55 | " |
| I-J | " | (I-72) | 2 g | +0.14 | −0.14 | The Invention |
| | | (V'-1) | 1 g | | | |
| I-K | " | (I-72) | 2 g | +0.15 | −0.16 | " |
| | | (VI-1) | 1 g | | | |
| I-L | " | (I-72) | 2 g | +0.14 | −0.15 | " |
| | | (VII-1) | 1 g | | | |
| I-M | " | (I-72) | 2 g | +0.13 | −0.14 | " |
| | | (V-7) | 1 g | | | |
| | | (VII-1) | 1 g | | | |
| I-N | " | (I-72) | 2 g | +0.12 | −0.13 | " |
| | | (VII-1) | 1 g | | | |
| | | (VII-8) | 1 g | | | |
| I-O | " | (I-67) | 2 g | +0.07 | −0.07 | " |
| | | (VIII-7) | 1 g | | | |
| I-P | Comparative Coupler *1 11 g | (I-72) | 2 g | +0.20 | −0.31 | Comparative Example |
| | | (VIII-1) | 1 g | | | |
| I-Q | Comparative Coupler *1 11 g | (I-72) | 2 g | +0.21 | −0.29 | " |
| | | (VII-1) | 1 g | | | |
| | | (VII-8) | 1 g | | | |

*1 1-(2,4,6-trichlorophenyl)-3-{3-[α-(2,4-di-tert-amylphenoxy)butyramido]benzamido}-5-pyrazolone Each sample with the dye image so formed thereon was subjected to discoloration testing for 4 weeks by the use of a fluorescent lamp fadeometer (20,000 lux) with an ultraviolet ray absorption filter (produced by Fuji Photo Film Co., Ltd.) eliminating wavelengths of 400 mμ or less. The results obtained are shown in Table 1.

From the results shown in Table 1, it can be seen that in Samples I-J to I-N of this invention, the discoloration of the magenta dye and the increase in the yellow color density of the white area are very low, and that these results could not be expected on the basis of the results when such materials are used singly. Furthermore, it can be seen that when couplers other than the 3-anilino-5-pyrazolone type magenta couplers of this invention are used, some effect can be obtained, but the effect is not sufficient, and that when they are used in combination with the 3-anilino-5-pyrazolone type magenta coupler according to this invention, the effect is sufficiently exhibited.

EXAMPLE 2

First Layer (the lowest layer) to Sixth Layer (the top layer) as illustrated in Table 2 were provided on a paper support with polyethylene laminated on both sides thereof to prepare a color light-sensitive member. The coating composition for preparing Third Layer was prepared according to the method of Example 1, and corresponding to the compounds added, the members are designated as in Table 3.

These samples were exposed to light at 1,000 lux/sec by the use of a sensitometer with a Green Filter (SP-2) (produced by Fuji Photo Film Co., Ltd.) and then processed as described in Example 1.

Each sample with the dye image so formed thereon was subjected to discoloration testing for 4 weeks by the use of a fluorescent lamp fadeometer (20,000 lux).

TABLE 2

| | |
|---|---|
| Sixth Layer (protective layer) | Gelatin (amount of coating: 1,000 mg/m$^2$) |
| Fifth Layer (red-sensitive layer) | Silver chlorobromide emulsion (Br: 50 mol %, amount of coating: silver 300 mg/m$^2$), Gelatin (amount of coating: 1,000 mg/m$^2$), Cyan coupler (*1) (amount of coating: 400 mg/m$^2$), Coupler solvent (*2) (amount of coating: 200 mg/m$^2$) |
| Fourth Layer (intermediate layer) | Gelatin (amount of coating: 1,200 mg/m$^2$), Ultraviolet ray absorbing agent (*3) (amount of coating: 1,000 mg/m$^2$), Solvent for ultraviolet ray absorbing agent (*2) (amount of coating: 250 mg/m$^2$) |
| Third Layer (green-sensitive layer) | Silver chlorobromide emulsion (Br: 50 mol %, amount of coating: silver 290 mg/m$^2$), Gelatin (amount of coating: 1,000 mg/m$^2$), Magenta coupler (amount of coating: 200 mg/m$^2$), Coupler solvent (*4) (amount of coating: 200 mg/m$^2$) |
| Second Layer (intermediate layer) | Gelatin (amount of coating: 1,000 mg/m$^2$) |
| First Layer (blue-sensitive layer) | Silver chlorobromide emulsion (Br: 80 mol %, amount of coating: silver 400 mg/m$^2$), Gelatin (amount of coating: 1,200 mg/m$^2$), Yellow coupler (*5) (amount of coating: 300 mg/m$^2$), Coupler solvent |

TABLE 2-continued

| | |
|---|---|
| Support | (*6) (amount of coating: 150 mg/m$^2$) Paper support with polyethylene laminated on both sides |

(*1) Coupler: 2-[α-(2,4-di-tert-pentylphenoxy)butanamido]-4,6-dichloro-5-methylphenol
(*2) Solvent: dibutyl phthalate
(*3) Ultraviolet ray absorbing agent: 2-(2-hydroxy-3-sec-butyl-5-tert-butylphenyl)-benzotriazole
(*4) Solvent: tricresyl phosphate
(*5) Coupler: α-pivaloyl-α-(2,4-dioxo-5,5'-dimethyl-oxazolidine-3-yl)-2-chloro-5-[α-(2,4-di-tert-pentylphenoxy)butanamido]acetanilide
(*6) Solvent: dioctylbutyl phosphate

TABLE 3

| Sample | Coupler | Compound Added | Change in Yellow Color Density in White Area | Change in Magenta Density (density prior to testing, 1.0) | Remarks |
|---|---|---|---|---|---|
| II-A | (1) 10 g | — | +0.23 | −0.78 | Comparative Example |
| II-B | " | (V'-1) (VII-1) | +0.18 | −0.31 | Comparative Example |
| II-C | " | (I-34) (V'-1) (VII-1) | +0.06 | −0.14 | The Invention |
| II-D | " | (II-18) (V'-1) (VII-1) | +0.09 | −0.13 | " |
| II-E | " | (III-3) (V'-1) (VII-1) | +0.10 | −0.14 | " |
| II-F | " | (IV-1) (V'-1) (VII-1) | +0.11 | −0.13 | " |
| II-G | " | (I-34) (VIII-7) (V'-1) | +0.06 | −0.07 | " |
| II-H | " | (I-68) (VIII-7) (V'-1) | +0.04 | −0.06 | " |
| II-I | " | (II-18) (VIII-7) (V'-1) | +0.08 | −0.07 | " |
| II-J | " | (III-3) (VIII-7) (V'-1) | +0.07 | −0.08 | " |
| II-K | " | (IV-1) (VIII-7) (V'-1) | +0.07 | −0.08 | " |

EXAMPLE 3

34 samples were prepared in the same manner as used in preparing Samples I-A to I-Q except that Couplers (8) and (18), respectively, were used in place of Coupler (1), and they were then processed and tested in the same manner as in Example 1. From the results as obtained in this testing, it became apparent that these additional samples according to this invention were excellent in discoloration properties as was the case with those of Example 1 and the coloration of the white area is low.

In preparing a silver halide color photographic light-sensitive element according to this invention, the couplers useful according to this invention may be used singly or in admixtures comprising two or more thereof, and furthermore may be used in combination with a magenta color image-forming coupler other than the couplers used according to this invention. In order to improve the color reproduction ability of the color photographic light-sensitive element, the magenta coupler used according to this invention can be used in combination with a cyan or yellow coupler having a different hue in the same emulsion layer, as described in Japanese Patent Publication No. 391/65.

As the other magenta color coupler, non-3-anilino pyrazolone compounds, indazolone compounds, cyanoacetyl compounds, etc., can be used. In particular, pyrazolone compounds are advantageous.

Examples of such non-3-anilino pyrazolone compounds which can be used in this invention are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, etc.

As the yellow coupler, known closed ketomethylene couplers can be used. Of these couplers, benzoylacetanilide and pyvaloylacetanilide compounds are advantageously used.

Examples of such yellow couplers which can be used in this invention are described in U.S. Pat. Nos. 2,875,057, 3,265,506, 3,408,194, 3,551,155, 3,582,322, 3,725,072, 3,891,445, West German Pat. No. 1,547,868, West German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

As the cyan coupler, phenol compounds, naphthol compounds, etc., can be used.

Examples of such cyan couplers which can be used in this invention are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, 90932/77.

In the present invention, colored couplers can also be used, such as those described, for example, in U.S. Pat. Nos. 3,476,560, 2,521,908, 3,034,892, Japanese Patent Publication Nos. 2106/69, 22335/63, 11304/67, 32461/69, Japanese Patent Application (OPI) Nos. 26034/76, 42121/77, and West German Patent Application (OLS) No. 2,418,959.

DIR couplers can also be used, such as those described, for example, in U.S. Pat. Nos. 3,227,554, 3,617,291, 3,701,783, 3,790,384, 3,632,345, West German Patent Application (OLS) Nos. 2,414,006, 2,454,301, 2,454,329, British Patent 953,454, Japanese Patent Application (OPI) Nos. 69624/77, 12335/74, and Japanese Patent Publication No. 16141/76.

In addition to the DIR coupler, those compounds which release a development inhibiting agent upon development may be incorporated into the light-sensitive element. For example, those as described in U.S. Pat. Nos. 3,297,445, 3,379,529, West German Patent Application (OLS) No. 2,417,914, Japanese Patent Application (OPI) Nos. 15271/77 and 9116/78 can be used.

Two or more of the above-described couplers can be incorporated into the same layer. The same compound can be incorporated into two or more different layers.

The amount of the coupler added is generally from $2\times10^{-3}$ mol to $5\times10^{-1}$ mol, and preferably from $1\times10^{-2}$ mol to $5\times10^{-1}$ mol, per mol of silver contained in the emulsion layer.

The photographic emulsion as used in this invention can be prepared by the methods as described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. Any of the acidic method, neutral method, ammonia method, etc., can be used. As a technique to react a soluble silver salt and a soluble halide, any of the single jet mixing method, the double jet mixing method and a combination thereof can be used.

A method of forming particles in the presence of an excess of silver ions (so-called reverse mixing method) can be used. As one technique of the double jet mixing method, a method in which pAg in the liquid phase where silver halide is formed is maintained at a constant level, i.e., so-called controlled double jet method can be used.

According to these methods described above, silver halide emulsions wherein a crystal form is regular and a grain size is nearly uniform can be obtained.

Two or more silver halide emulsions separately prepared may be incorporated by mixing with each other, if desired.

Formation or physical aging of silver halide particles may be carried out in the presence of a cadmium salt, a zinc salt, a lead salt, a thallium salt, an iridium salt or an iridium complex salt, a rhodium salt or a rhodium complex salt, an iron salt or an iron complex salt, etc.

As a binder or protective colloid for use in the photographic emulsion, it is advantageous to use gelatin, but hydrophilic colloids other than gelatin can be used. For example, various kinds of synthetic hydrophilic polymeric substances such as proteins, e.g., gelatin derivatives, graft polymers of gelatin and other polymers, albumin, casein, etc.; cellulose derivatives, e.g., hydroxyethyl cellulose, carboxymethyl cellulose, cellulose sulfuric acid esters, etc.; sugar derivatives, e.g., sodium alginate, starch derivatives, etc.; and homo- or copolymers, e.g., polyvinyl alcohol, partial acetal of polyvinyl alcohol, poly-N-vinylpyrrolidone, polyacrylic acid, polymethacrylic acid, polyacrylamide, polyvinyl imidazole, polyvinyl pyrazole, etc., can be used.

As the gelatin as used in this invention, acid-processed gelatin and oxygen-processed gelatin as described in *Bull. Soc. Sci. Phot. Japan,* No. 16, p. 30 (1966), as well as lime-processed gelatin, may be used. Additionally, hydrolyzed products and oxygen decomposition products of gelatin can be used.

Gelatin derivatives which can be used include those prepared by reacting gelatin with various compounds such as acid halide, acid anhydrides, isocyanates, bromoacetates, alkanesultones, vinylsulfonamides, maleinimido compounds, polyalkylene oxides, epoxy compounds, etc. Examples of such gelatin derivatives are described in U.S. Pat. Nos. 2,614,928, 3,132,945, 3,186,846, 3,312,553, British Pat. Nos. 861,414, 1,033,189, 1,005,784, Japanese Patent Publication Nos. 26845/67, etc.

Gelatin graft polymers which can be used include those prepared by grafting a homo- or copolymer of a vinyl monomer such as acrylic acid, methacrylic acid and their derivatives, e.g., esters and amides, acrylonitrile, styrene, etc., on gelatin. In particular, graft polymers of gelatin and polymers which are mutually soluble with the gelatin, at least to some extent, such as polymers of acrylic acid, methacrylic acid, acrylamide, methacrylamide, hydroxyalkyl methacrylate, etc., are preferably used. These graft polymers are described in U.S. Pat. Nos. 2,763,625, 2,831,767, 2,956,884, etc.

Typical synthetic hydrophilic polymeric substances are described in West German Patent Application (OLS) Nos. 2,312,708, U.S. Patents 3,620,751, 3,879,205, and Japanese Patent Publication No. 7561/68.

For the purpose of inhibiting fog in the course of production of the light-sensitive element, during the storage thereof or in the course of photographic processings, or of stabilizing photographic characteristics, various compounds can be incorporated into the photographic emulsion as used in this invention. Many compounds known as antifoggants or stabilizers, such as azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compunds, e.g., oxazolinethion; azaindenes, e.g., triazaindenes, tetrazaindenes (particularly, 4-hydroxy-substituted (1,3,3a,7)tetrazaindenes), pentazaindenes, etc.; benzenethiosulfonic acid, benzenesulfonic acid, benzenesulfonic acid amides, etc., can be added. For example, those as described in U.S. Pat. Nos. 3,954,474, 3,982,947, and Japanese Patent Publication No. 28660/77 can be used.

For the purpose of increasing the sensitivity and contrast of the photographic light-sensitive element, or of accelerating the development thereof, polyalkyleneoxide or its ether, ester, amine and like derivatives, thioether compounds, thiomorpholines, quaternary ammonium salt compounds, urethane derivatives, urea derivatives, imidazole derivatives, 3-pyrazolidones, etc., may be incorporated into the photographic emulsion layer of the photographic light-sensitive element. For example, those as described in U.S. Pat. Nos. 2,400,532, 2,423,549, 2,716,062, 3,617,280, 3,772,021, 3,808,003, British Patent 1,488,991, etc., can be used.

In the light-sensitive element as used in this invention, the photographic emulsion and other hydrophilic colloid layers may contain a brightening agent, e.g., stylben-, triazine-, oxazole- or cumarin-based brightening agents. These compounds may be soluble in water, or water-insoluble brightening agents may be used in the form of a dispersion. Representative examples of such brightening agents are described in U.S. Pat. Nos. 2,632,701, 3,269,840, 3,359,102, British Pat. Nos. 852,075, 1,319,763, etc.

In the light-sensitive element as used in this invention, the hydrophilic colloid layer may contain a water-soluble dye as a filter dye, for prevention of irradiation or other conventional purposes. Examples of such dyes include oxonol dye, hemioxonol dye, styryl dye, merocyanine dye, cyanine dye and azo dye. Of these days, the oxonol dye, hemioxonol dye and merocyanine dye are most useful. Examples of dyes which can be used are described in British Pat. Nos. 584,609, 1,177,429, Japanese Patent Application (OPI) Nos. 85130/73, 99620/74, 114420/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312, 4,070,352.

The photographic emulsion as used in this invention may be spectrally sensitized with methine dyes or other compounds. Dyes which can be used for that purpose include cyanine dyes, merocyanine dyes, composite cyanine dyes, composite merocyanine dyes, holopolar cyanine dyes, hemicyanine dyes, styryl dyes, and hemioxonol dyes. Particularly useful dyes are the cyanine dyes, merocyanine dyes, and composite merocyanine dyes. Any nuclei which are usually used in cyanine dyes as basic heterocyclic nuclei can be used for the above-described dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei wherein an alicyclic hydrocarbon ring is condensed with the above nuclei; and nuclei wherein aromatic hydrocarbon ring is condensed with the above nuclei, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be applied. These nuclei may be substituted on the carbon atom.

The merocyanine dye or composite merocyanine dye used can include a nucleus having a ketomethylene structure and/or a 5- or 6-membered heterocyclic nucleus, such as a pyrazoline-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, etc.

Useful sensitizing dyes are those as described, for example, in German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Patent 1,242,588, Japanese Patent Publication Nos. 14030/79 and 24844/77.

These sensitizing dyes may be used singly or in combination with each other. Combinations of sensitizing dyes are often used for the purpose of improving sensitization. Representative examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/78, 12375/78, Japanese Patent Application (OPI) Nos. 10618/77 and 109925/77.

Those substances which have no sensitization action by themselves or do not substantially absorb visible light, but exhibit supersensitization may be incorporated into the emulsion together with the sensitization dye. Examples of such substances include aminostilbene compounds substituted by a nitrogen-containing heterocyclic group (for example, those as described in U.S. Pat. Nos. 2,933,390 and 3,635,721), aromatic organic acid-formaldehyde condensates (for example, those as described in U.S. Pat. No. 3,743,510), cadmium salts, azaindene compounds, etc. Combinations as described in U.S. Pat. Nos. 3,615,613, 3,615,641, 3,617,295 and 3,635,721 are particularly useful.

This invention can be applied to a multilayer multicolor photographic element carrying at least two different spectrally sensitized layers on the support. The multilayer natural color photographic element usually comprises a support and at least one layer of each of a red-sensitive emulsion layer, a green-sensitive emulsion layer and a blue-sensitive emulsion layer, on the support. The order of these layers can be selected as desired. Usually, the red-sensitive emulsion layer contains a cyan-forming coupler, the green-sensitive emulsion layer contains a magenta-forming coupler and the blue-sensitive emulsion layer contains a yellow-forming coupler. In some cases, different combinations can be used.

The light-sensitive element as used in this invention may contain as a color antifoggant a hydroquinone derivative, an aminophenol derivative, a gallic acid derivative, as ascorbic acid derivative, etc. Examples of such antifoggants are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, Japanese Patent Publication No. 23813/75, etc.

The light-sensitive element as used in this invention may contain an ultraviolet ray absorbing agent in the hydrophilic colloid layer. Ultraviolet ray absorbing agents which can be used include benzotriazole compounds substituted by an aryl group (for example, those as described in U.S. Pat. No. 3,533,794), 4-thiazolidone compounds (for example, those as described in U.S. Pat. Nos. 3,314,794 and 3,352,681), benzophenone compounds (for example, those as described in Japanese Patent Application (OPI) No. 2784/71), cinnamic acid ester compounds (for example, those as described in U.S. Pat. Nos. 3,705,805 and 3,707,375), butadiene compounds (for example, those as described in U.S. Pat. No. 4,045,229), and benzoxyzole compounds (for example, those as described in U.S. Pat. No. 3,700,455). Additionally, those as described in U.S. Pat. No. 3,499,762 and Japanese Patent Application (OPI) No. 48535/79 can be used. Ultraviolet ray-absorbing couplers (for example, α-naphthol-based cyan dye-forming couplers) and ultraviolet ray-absorbing polymers may be used. These ultraviolet ray absorbing agents may be mordanted to a specific layer.

In photographic-processing the light-sensitive element used according to this invention, any known methods can be used. Known processing solutions can be used. The processing temperature is selected from the range of 18° C. to 50° C., but the processing may be carried out at temperatures lower than 18° C. or higher than 50° C. Depending upon the purpose, either of the development processing (black-and-white photographic processing) to form a silver image and the color photographic processing comprising a development processing to form a dye image can be applied.

Processes that can be employed for image development include: (1) the negative-positive process (described, for example, in the *Journal of the Society of Motion Picture and Television Engineers,* Vol. 61, pp. 667 to 701 (1953)); (2) the color reversal process, wherein a negative silver image is formed by developing with a developer containing a black-and-white developing agent, after which it is subjected to at least one uniform exposure or another suitable fog processing and subsequently is subjected to color development to obtain a dye positive image; and (3) the silver dye bleaching process, wherein a photographic emulsion layer containing a dye is exposed and developed to form a silver image, and the dye is bleached by using the silver image as a bleaching catalyst.

The color developer generally comprises an alkaline aqueous solution containing a color developing agent. As the color developing agent, known primary aromatic amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.) can be used.

In addition, color developers described in L. F. A. Mason, *Photographic Processing Chemistry,* Focal Press, pp. 226–229 (1966), U.S. Pat. Nos. 2,193,015, 2,592,364, Japanese Patent Application (OPI) No. 64933/73, etc., may be employed.

The color developer can further contain a pH buffer agent, such as sulfites, carbonates, borates and phosphates of alkali metals, a development-inhibiting agent, such as bromides and iodides, an antifoggant such as an organic antifoggant. As necessary, it may contain a hard water-softening agent, a preservative, such as hydroxylamine, an organic solvent, such as benzyl alcohol, diethylene glycol, a development accelerator, such as polyethylene glycol, a quaternary ammonium salt, amines, a color-forming coupler, a competition coupler, a foggant, such as sodium borohalide, an auxiliary developing agent, such as 1-phenyl-3-pyrazolidone, a tackifier, a polycarboxylic acid-based chelating agent as described in U.S. Pat. No. 4,083,723, an antioxidant as described in West German Patent Application (OLS) No. 2,622,950, etc.

The photographic emulsion layer after the color development is usually subjected to a bleach processing. The bleach processing and the fix processing may be carried out either at the same time (referred to as "bleach-fixing" or "blixing") or separately.

Bleaching agents which can be used include polyvalent metal (e.g., iron (III), cobalt (III), chromium (VI), copper (II), etc.) compounds, peracids, quinones, nitroso compounds, etc. For example, ferricyanides, dichromates, organic complex salts of iron (III) or cobalt (III), aminopolycarboxylic acids, such as ethylenediaminetetraacetate, nitrilotriacetate, 1,3-diamino-2-propanol tetraacetate, etc., and complex salts of organic acids, such as citric acid, tartaric acid, malic acid, etc.; persulfates, permanganates; nitrosophenol, etc., can be used. Of these compounds, potassium ferricyanide, ethylenediaminetetraacetate iron (III) sodium and ethylenediaminetetraacetate iron (II) ammonium are particularly useful. The ethylenediaminetetraacetate iron (III) complex salt is useful either in the independent bleaching solution or in a single bath bleach-fixing solution.

Bleach accelerators can be added to the bleaching or bleach-fixing solution, as described in U.S. Pat. Nos. 3,042,520, 3,241,966, Japanese Patent Publication Nos. 8506/70, 8836,70, etc., thiol compounds as described in Japanese Patent Application (OPI) No. 65732/78, as well as various other additives.

While the invention has been described in detail and with reference to specific embodiments thereof, it will be apparent to one skilled in the art that various changes and modifications can be made therein without departing from the spirit and scope thereof.

What is claimed is:

1. A process for improving the light fastness of a magenta color image comprising incorporating at least one member of the complexes represented by the following formulae (I), (II), (III) and (IV), and at least one member of the discoloration prevention aids represented by the following formulae (V), (VII) and (VIII) in a layer in which said magenta color image can be formed by reaction of a 3-anilino-5-pyrazolone type magenta coupler and an oxidation product of an aromatic primary amine developing agent; wherein formulae (I), (II), (III), and (IV) are (I)

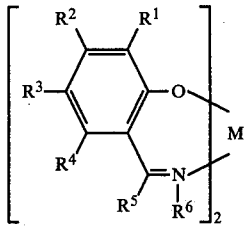

(II)

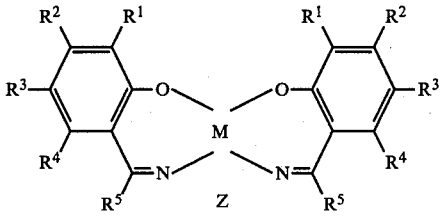

(III)

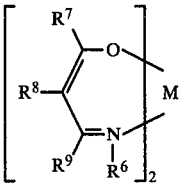

-continued

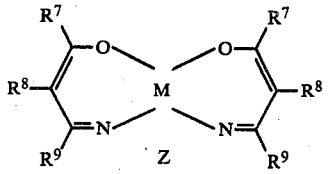

(IV)

wherein

M is Cu, Co, Ni, Pd or Pt;

$R^1$, $R^2$, $R^3$, and $R^4$ are each hydrogen, a halogen atom, a cyano group, an alkyl group linked to the carbon atom of the benzene nucleus either directly or through a divalent linking group, an aryl group, a cycloalkyl group, or a heterocyclic group, or $R^1$ and $R^2$, $R^2$ and $R^3$, or $R^3$ and $R^4$ represent a group of non-metallic atoms combining with each other to form a 6-membered ring;

$R^5$, $R^8$, and $R^9$ can each represent hydrogen, an alkyl group, or an aryl group, or $R^8$ or $R^9$ together represent a group of non-metallic atoms combining to form a 5- to 8-membered ring;

$R^6$ is hydrogen, an alkyl group, an aryl group, or a hydroxy group;

$R^7$ can represent an alkyl group or an aryl group, or $R^7$ and $R^8$ together represent a group of non-metallic atoms combining to form a 5- to 8-membered ring; and Z is a group of non-metallic atoms forming a 5- or 6-membered ring; and wherein formula (V), (VII) and (VIII) are

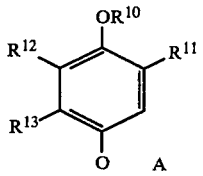

(V)

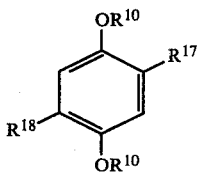

(VII)

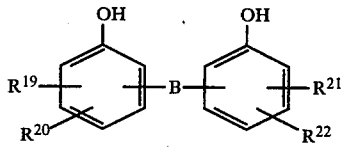

(VIII)

wherein $R^{10}$ is hydrogen, an alkyl group, an acyl group a sulfonyl group, a carbamoyl group, a sulfamoyl group, an alkoxycarbonyl group, or a trialkylsilyl group;

A is a group of non-metallic atoms completing a 5- or 6-membered ring in combination with the group

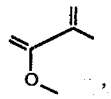

and may contain a bisspiro bond;

$R^{11}$, $R^{12}$, and $R^{13}$ are each hydrogen, an alkyl group, an alkoxy group, an aryl group, an aryloxy group, an aralkyl group, an aralkoxy group, an alkenyl group, an alkenoxy group, an acylamino group, a halogen atom, an alkylthio group, an arylthio group, a diacylamino group, an alkoxycarbonyl group, an acyloxy group, an acyl group or a sulfonamido group;

$R^{17}$ is hydrogen, a straight chain or branched chain alkyl group containing from 1 to 22 carbon atoms, or an alkenyl group containing from 3 to 22 carbon atoms;

$R^{18}$ is a straight chain or branched chain alkyl group containing from 1 to 22 carbon atoms or an alkenyl group containing from 3 to 22 carbon atoms;

B is —S—, —S—S—, —O—, $—CH_2—S—CH_2—$, $SO_2$—, —SO—, $—CH_2—O—CH_2—$,

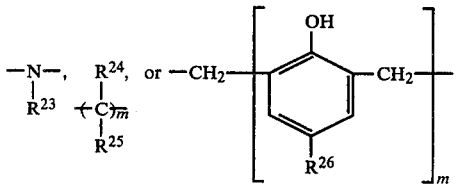

$R^{19}$, $R^{20}$, $R^{21}$, and $R^{22}$ are each hydrogen, an alkyl group, an aryl group, an aralkyl group, an alkylthio group, a halogen atom, an alkoxy group, an arylthio group, an aralkoxy group, an aryloxy group, $—COOR^{27}$, $—NHCOR^{27}$, $—NHSO_2R^{27}$, $—O—COR^{27}$,

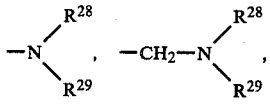

or $—CH_2)_nD$, all containing from 1 to 22 carbon atoms;

$R^{23}$ is hydrogen, an alkyl group or an aryl group; $R^{24}$ and $R^{25}$ are each hydrogen, or an aryl group, or they combine together to form a substituted 5- or 6-membered ring; $R^{26}$ is hydrogen or a methyl group; $R^{27}$ is an alkyl group or an aryl group; $R^{28}$ and $R^{29}$ are each hydrogen, an alkyl group, an aryl group, a heterocyclic group or an aralkyl group, or they combine together to form a substituted 5- or 6-membered heterocyclic ring;

D is an ester group or

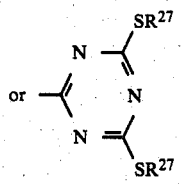

and m and n are each an integer of from 1 to 3.

2. A process for improving the light fastness of a magenta color image as in claim 1, wherein said 3-anilino type magenta coupler is a compound represented by formula (IX)

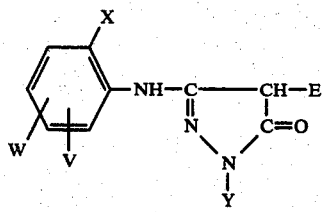

(IX)

wherein X is an alkyl group, an alkoxy group, an alkylthio group, an amido group, a halogen atom, a hydroxy group or a cyano group; Y is an aryl group or a heterocyclic group; E is hydrogen or a coupling-off group; W is hydrogen or a hydrophobic group; and V is hydrogen or a group as defined for X or W.

3. A process for improving the light fastness of a magenta color image as in claim 1, wherein said 3-anilino type magenta coupler is a compound represented by formula (X)

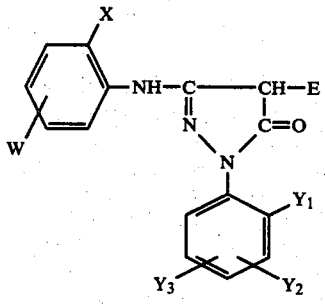

(X)

wherein X is an alkyl group, an alkoxy group, a halogen atom, a hydroxy group, a cyano group or a nitro group; $Y_1$ is a halogen atom, an alkyl group, an alkoxy group, an alkoxycarbonyl group, a nitro group, an aryloxy group, a cyano group or an acylamino group; $Y_2$ and $Y_3$ each represents hydrogen or a group as defined for $Y_1$; E is hydrogen or a coupling-off group; and W is hydrogen or a hydrophobic group.

4. A process for improving the light fastness of a magenta color image as in claim 1, 2, or 3, wherein the halogen atoms represented by $R^1$, $R^2$, $R^3$, and $R^4$ include fluorine, chlorine, bromine, and iodine; and alkyl groups represented by $R^1$, $R^2$, $R^3$, and $R^4$ contain from 1 to 19 carbon atoms, and may be straight chain or branched chain, or substituted or unsubstituted; the aryl groups represented by $R^1$, $R^2$, $R^3$, and $R^4$ contain from 6 to 14 carbon atoms and may be substituted or unsubstituted; the heterocyclic rings represented by $R^1$, $R^2$, $R^3$, and $R^4$ are 5- or 6-membered rings, and may be substituted or unsubstituted; the cycloalkyl groups represented by $R^1$, $R^2$, $R^3$, and $R^4$ are 5- or 6-membered rings and may be substituted or unsubstituted; and the 6-membered rings formed by $R^1$ and $R^2$, $R^2$ and $R^3$, or $R^3$ or $R^4$ are benzene rings and said benzene rings may be substituted or unsubstituted, or may be part of a condensed ring structure.

5. A process for improving the light fastness of a magenta color image as in claim 1, wherein the straight chain or branched chain alkyl groups represented by $R^1$, $R^2$, $R^3$, and $R^4$ are selected from a methyl group, an ethyl group, a propyl group, a butyl group, a hexyl group, an octyl group, a decyl group, a dodecyl group, a tetradecyl group, a hexadecyl group, and an octadecyl group; the aryl groups represented by $R^1$, $R^2$, $R^3$, and $R^4$ are selected from a phenyl group and a naphthyl group; the heterocyclic rings represented by $R^1$, $R^2$, $R^3$, and $R^4$ are selected from a 5- or 6-membered heterocyclic ring containing as a hetero atom at least one nitrogen atom, oxygen atom or sulfur atom in the ring thereof; the cycloalkyl groups represented by $R^1$, $R^2$, $R^3$, and $R^4$ are selected from a cyclopentyl group, a cyclohexyl group, a cyclohexenyl group, and a cyclohexadienyl group; and the 6-membered rings obtained by the bonding of $R^1$ and $R^2$, $R^2$ and $R^3$, or $R^3$ and $R^4$ are selected from a benzene ring, a naphthalene ring, an isobenzothiophene ring, an isobenzofuran ring, and an isoindoline ring.

6. A process for improving the light fastness of a magenta color image as in claim 1 or 5, wherein the alkyl groups, cycloalkyl groups, aryl groups, or heterocyclic rings represented by $R^1$, $R^2$, $R^3$, and $R^4$ are linked to the carbon atom of the benzene nucleus through a divalent linking group selected from an oxy group (—O—), a thio group (—S—), an amino group, an oxycarbonyl group, a carbonyl group, a carbamoyl group, a sulfamoyl group, a carbonylamino group, a sulfonylamino group, a sulfonyl group, or a carbonyloxy group.

7. A process for improving the light fastness of a magenta color image as in claim 1, wherein the alkyl groups represented by $R^5$, $R^6$, $R^7$, $R^8$, and $R^9$ include both substituted alkyl groups and unsubstituted alkyl groups which may be either straight chain or branched chain, and wherein the number of carbon atoms of the alkyl groups, excluding the carbon atoms of the substituent portion, is from 1 to 20; the aryl groups represented by $R^5$, $R^6$, $R^7$, $R^8$ or $R^9$ include both substituted aryl groups and unsubstituted aryl groups, wherein the number of carbon atoms of the aryl groups, excluding the carbon atoms of the substituent portion, is from 6 to 14.

8. A process for improving the light fastness of a magenta color image as in claim 1, wherein said at least one complex is selected from complexes represented by formulae (I), (IIa), (IIIa), (IIIb) and (IVa)

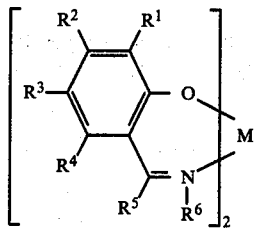

(I)

-continued (IIa)

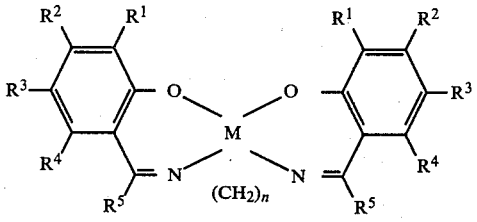

(IIIa)

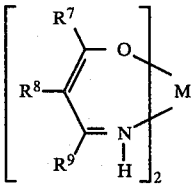

(IIIb)

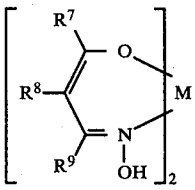

(IVa)

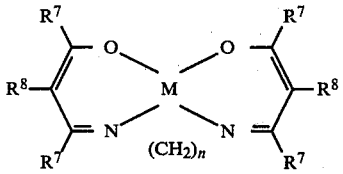

wherein $R^1$, $R^2$, $R^3$, $R^4$, $R^5$, $R^6$, $R^7$, $R^8$, $R^9$, and M each have the same meaning as defined in claim 1, and n is 2 or 3.

9. A process for improving the light fastness of a magenta color image as in claim 8, wherein said at least one complex is (I) or (IIa).

10. A process for improving the light fastness of a magenta color image as in claim 9, wherein at least one of $R^1$, $R^2$, $R^3$, and $R^4$ is an alkyl group or an alkoxy group.

11. A process for improving the light fastness of a magenta color image as in claim 9 or 10, wherein the total number of carbon atoms contained in the groups represented by $R^1$, $R^2$, $R^3$, $R^4$, $R^5$, and $R^6$ is at least 4.

12. A process for improving the light fastness of a magenta color image as in claim 1 or 8, wherein M is Cu, Co or Ni.

13. A process for improving the light fastness of a magenta color image as in claim 1 or 8, wherein M is Ni.

14. A process for improving the light fastness of a magenta color image as in claim 1 or 8, wherein $R^{10}$ is hydrogen, an alkyl group containing from 1 to 22 carbon atoms, an acyl group, a sulfonyl group, a carbamoyl group, a sulfamoyl group, an alkoxycarbonyl group, or a trialkylsilyl group;

A is a group of non-metallic atoms forming a 5- or 6-membered ring in combination with $$-\overset{|}{C}=\overset{|}{C}-O-,$$

wherein the 5- or 6-membered ring may be substituted with an alkyl group, an alkoxy group, an aryl group, an aryloxy group, an aralkyl group, an aralkoxy group, an alkenyl group, an N-substituted amino group, a heterocyclic group, or by a radical forming a condensed ring, and the alkyl group and aryl group may be substituted with a halogen atom, a hydroxy group, a carboxy group, an alkoxycarbonyl group, an acyloxy group, a sulfo group, a sulfonyloxy group, an amido group, an alkoxy group, or an aryloxy group;

$R^{11}$, $R^{12}$, and $R^{13}$ are each hydrogen, an alkyl group, an alkoxy group, an aryl group, an aryloxy group, an aralkyl group, an aralkoxy group, an alkenyl group, an alkenoxy group, an acylamino group, a halogen atom, an alkylthio group, a diacylamino group, an arylthio group, an alkoxycarbonyl group, an acyloxy group, an acyl group, or a sulfonamido group;

$R^{17}$ is hydrogen, a straight chain or branched chain alkyl group containing from 1 to 22 carbon atoms, or an alkenyl group containing from 3 to 22 carbon atoms; and $R^{18}$ is a straight chain or branched chain alkyl group containing from 1 to 22 carbon atoms, or an alkenyl group containing from 3 to 22 carbon atoms.

15. A process for improving the light fastness of a magenta color image as in claim 14, wherein the compound represented by formula (V) comprises a bisspiro compound represented by formula (V')

(V')

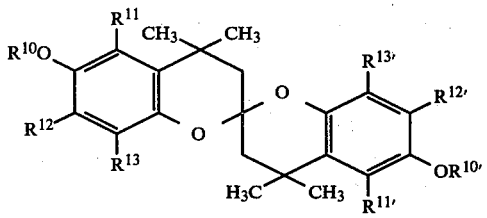

wherein $R^{10}$, $R^{11}$, $R^{12}$, and $R^{13}$ have the same meanings as $R^{10}$, $R^{11}$, $R^{12}$, and $R^{13}$, respectively in claim 14, and $R^{10'}$, $R^{11'}$, $R^{12'}$, and $R^{13'}$ also have the same meanings as $R^{10}$, $R^{11}$, $R^{12}$, and $R^{13}$, respectively in claim 14.

16. A process for improving the light fastness of a magenta color image as in claim 14, wherein said discoloration prevention aid is selected from the compounds represented by formula (V), wherein the total number of carbon atoms contained in $R^{11}$, $R^{12}$, $R^{13}$ is at least 8.

17. A process for improving the light fastness of a magenta color image as in claim 14, wherein said discoloration prevention aid is selected from the compounds represented by formula (V), wherein $R^{11}$, $R^{12}$, and $R^{13}$, are each an alkyl group, an alkoxy group, an aryl group, an aryloxy group or an alkylthio group.

18. A process for improving the light fastness of a magenta color image as in claim 15, wherein said discoloration prevention aid is a compound represented by formula (V'), wherein $R^{11}$, $R^{12}$, $R^{13}$, $R^{11'}$, $R^{12'}$, and $R^{13'}$ are each an alkyl group, an alkoxy group, an aryl group, an aryloxy group or an alkylthio group.

19. A process for improving the light fastness of a magenta color image as in claim 1 or 8, wherein the amount of the complex is from about 0.01 mol to about 10 mols per mol of the magenta coupler.

20. A process for improving the light fastness of a magenta color image as in claim 1 or 8, wherein the amount of the complex is from 0.05 mol to 2 mols per mol of the magenta coupler.

21. A process for improving the light fastness of a magenta color image as in claim 1 or 8, wherein the amount of the discoloration prevention aid is from about 0.01 to 10 mols per mol of the magenta coupler.

22. A process for improving the light fastness of a magenta color image as in claim 1 or 8, wherein the amount of the discoloration prevention aid is from 0.1 mol to 5 mols per mol of the magenta coupler.

23. A process for improving the light fastness of a magenta color image as in claim 14, wherein the amount of the complex is from about 0.01 mol to about 10 mols per mol of the magenta coupler.

24. A process for improving the light fastness of a magenta color image as in claim 14, wherein the amount of the complex is from 0.05 mol to 2 mols per mol of the magenta coupler.

25. A process for improving the light fastness of a magenta color image as in claim 14, wherein the amount of the discoloration prevention aid is from about 0.01 to 10 mols per mol of the magenta coupler.

26. A process for improving the light fastness of a magenta color image as in claim 14, wherein the amount of the discoloration prevention aid is from 0.1 mol to 5 mols per mol of the magenta coupler.

27. A color photographic light-sensitive element comprising at least one layer containing a 3-anilino-5-pyrazolone type magenta coupler capable of forming a magenta color image with an oxidation product of an aromatic primary amine developing agent, and a layer in which said magenta color image can be formed containing at least one member of the complexes represented by the following formulae (I), (II), (III), and (IV), and at least one member of the discoloration prevention aid represented by the following formulae (V), (VII) and (VIII)

wherein formulae (I), (II), (III), and (IV) are (I)

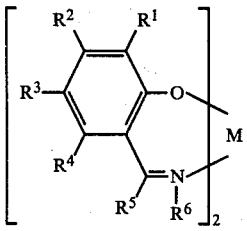

(II)

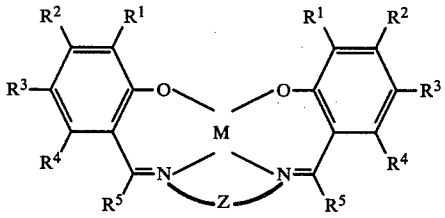

(III)

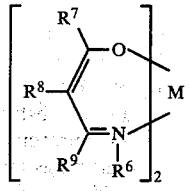

-continued (IV)

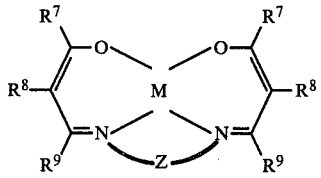

wherein

M is Cu, Co, Ni, Pd or Pt;

$R^1$, $R^2$, $R^3$, and $R^4$ are each hydrogen, a halogen atom, a cyano group, an alkyl group linked to the carbon atom of the benzene nucleus either directly or through a divalent linking group, an aryl group, a cycloalkyl group, or a heterocyclic group, or $R^1$ and $R^2$, $R^2$ and $R^3$, or $R^3$ and $R^4$ represent a group of non-metallic atoms combining with each other to form a 6-membered ring;

$R^5$, $R^8$, and $R^9$ can each represent hydrogen, an alkyl group, or an aryl group, or $R^8$ and $R^9$ together represent a group of non-metallic atoms combining to form a 5- to 8-membered ring;

$R^6$ is hydrogen, an alkyl group, an aryl group, or a hydroxy group;

$R^7$ can represent an alkyl group or an aryl group, or $R^7$ and $R^8$ together represent a group of non-metallic atoms combining to form a 5- to 8-membered ring; and Z is a group of non-metallic atoms forming a 5- or 6-membered ring;

and wherein formulae (V), (VII) and (VIII) are (V)

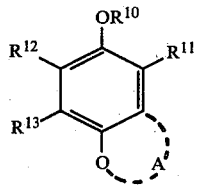

(VII)

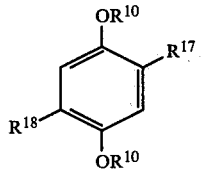

(VIII)

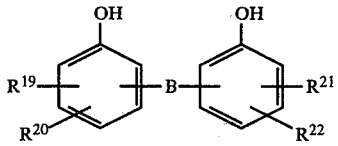

wherein $R^{10}$ is hydrogen, an alkyl group, an acyl group, a sulfonyl group, a carbamoyl group, a sulfamoyl group, an alkoxycarbonyl group, or a trialkylsilyl group;

A is a group of non-metallic atoms completing a 5- or 6-membered ring in combination with the group

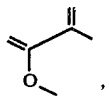

and may contain a bisspiro bond;

$R^{11}$, $R^{12}$, $R^{13}$ are each hydrogen, an alkyl group, an alkoxy group, an aryl group, an aryloxy group, an aralkyl group, an aralkoxy group, an alkenyl group, an alkenoxy group, an acylamino group, a halogen atom, an alkylthio group, an arylthio group, a diacylamino group, an alkoxycarbonyl group, an acyloxy group, an acyl group or a sulfonamido group;

$R^{17}$ is hydrogen, a straight chain or branched chain alkyl group containing from 1 to 22 carbon atoms, or an alkenyl group containing from 3 to 22 carbon atoms;

$R^{18}$ is a straight chain or branched chain alkyl group containing from 1 to 22 carbon atoms or an alkenyl group containing from 3 to 22 carbon atoms;

B is —S—, —S—S—, —O—, $—CH_2—S—CH_2—$, $—SO_2—$, —SO—, $—CH_2—O—CH_2—$,

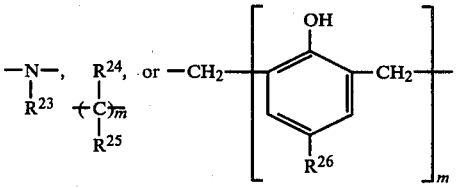

$R^{19}$, $R^{20}$, $R^{21}$, and $R^{22}$ are each hydrogen, an alkyl group, an aryl group, an aralkyl group, an alkylthio group, a halogen atom, an alkoxy group, an arylthio group, an aralkoxy group, an aryloxy group, $—COOR^{27}$, $—NHCOR^{27}$, $—NHSO_2R^{27}$, $—O—COR^{27}$,

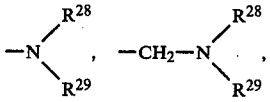

or $—CH_2)_nD$, all containing from 1 to 22 carbon atoms;

$R^{23}$ is hydrogen, an alkyl group or an aryl group; $R^{24}$ and $R^{25}$ are each hydrogen, or an aryl group, or they combine together to form a substituted 5- or 6-membered ring; $R^{26}$ is hydrogen or a methyl group; $R^{27}$ is an alkyl group or an aryl group; $R^{28}$ and $R^{29}$ are each hydrogen, an alkyl group, an aryl group, a heterocyclic group or an aralkyl group, or they combine together to form a substituted 5- or 6-membered heterocyclic ring;

D is an ester group or

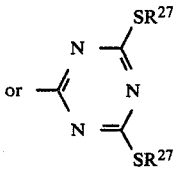

and m and n are each an integer of from 1 to 3.

28. A color photographic light-sensitive element as in claim 27, wherein said 3-anilino type magenta coupler is a compound represented by formula (IX)

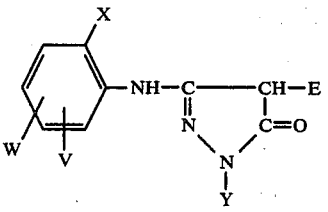

(IX)

wherein X is an alkyl group, an alkoxy group, an alkylthio group, an amido group, a halogen atom, a hydroxy group or a cyano group; Y is an aryl group or a heterocyclic group; E is hydrogen or a coupling-off group; W is hydrogen or a hydrophobic group; and V is hydrogen or a group as defined for X or W.

29. A color photographic light-sensitive element as in claim 27, wherein said 3-anilino type magenta coupler is a compound represented by formula (X)

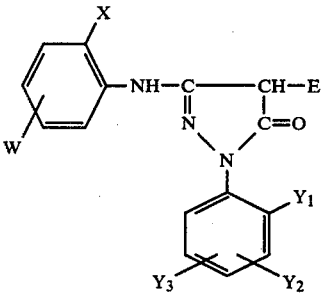

(X)

wherein X is an alkyl group, an alkoxy group, a halogen atom, a hydroxy group, a cyano group or a nitro group; $Y_1$ is a halogen atom, an alkyl group, an alkoxy group, an alkoxycarbonyl group, a nitro group, an aryloxy group, a cyano group or an acylamino group; $Y_2$ and $Y_3$ each represents hydrogen or a group as defined for $Y_1$; E is hydrogen or a coupling-off group; and W is hydrogen or a hydrophobic group.

30. A color photographic light-sensitive element as in claim 27, 28, or 29, wherein the halogen atoms represented by $R^1$, $R^2$, $R^3$, and $R^4$ include fluorine, chlorine, bromine, and iodine; the alkyl groups represented by $R^1$, $R^2$, $R^3$, and $R^4$ contain from 1 to 19 carbon atoms, and may be straight chain or branched chain, or substituted or unsubstituted; the aryl groups represented by $R^1$, $R^2$, $R^3$, and $R^4$ contain from 6 to 14 carbon atoms and may be substituted or unsubstituted; the heterocyclic rings represented by $R^1$, $R^2$, $R^3$, and $R^4$ are 5- or 6-membered rings, and may be substituted or unsubstituted; the cycloalkyl groups represented by $R^1$, $R^2$, $R^3$, and $R^4$ are 5- or 6-membered rings and may be substituted or unsubstituted; and the 6-membered rings formed by $R^1$ and $R^2$, $R^2$ and $R^3$, or $R^3$ or $R^4$ are benzene rings and said benzene rings may be substituted or unsubstituted, or may be part of a condensed ring structure.

31. A color photographic light-sensitive element as in claim 27, wherein the straight chain or branched chain alkyl groups represented by $R^1$, $R^2$, $R^3$, and $R^4$ are selected from a methyl group, an ethyl group, a propyl group, a butyl group, a hexyl group, an octyl group, a decyl group, a dodecyl group, a tetradecyl group, a hexadecyl group, and an octadecyl group; the aryl groups represented by $R^1$, $R^2$, $R^3$, and $R^4$ are selected from a phenyl group and a naphthyl group; the heterocyclic rings represented by $R^1$, $R^2$, $R^3$, and $R^4$ are selected from a 5- or 6-membered heterocyclic ring containing as a hetero atom at least one nitrogen atom, oxygen atom or sulfur atom in the ring thereof; the cycloalkyl groups represented by $R^1$, $R^2$, $R^3$, and $R^4$ are selected from a cyclopentyl group, a cyclohexyl group, a cyclohexenyl group, and a cyclohexadienyl group; and the 6-membered rings obtained by the bonding of $R^1$ and $R^2$, $R^2$ and $R^3$, or $R^3$ and $R^4$ are selected from a benzene ring, a naphthalene ring, an isobenzothiophen ring, an isobenzofuran ring, and an isoindoline ring.

32. A color photographic light-sensitive element as in claim 27, or 31, wherein the alkyl groups, cycloalkyl groups, aryl groups, or heterocyclic rings represented by $R^1$, $R^2$, $R^3$, and $R^4$ are linked to the carbon atom of the benzene nucleus through a divalent linking group selected from an oxy group (—O—), a thio group (—S—), an amino group, an oxycarbonyl group, a carbonyl group, a carbamoyl group, a sulfamoyl group, a carbonylamino group, a sulfonylamino group, a sulfonyl group, or a carbonyloxy group.

33. A color photographic light-sensitive element as in claim 27, wherein the alkyl groups represented by $R^5$, $R^6$, $R^7$, $R^8$, and $R^9$ include both substituted alkyl groups and unsubstituted alkyl groups which may be either straight chain or branched chain, and wherein the number of carbon atoms of the alkyl groups, excluding the carbon atoms of the substituent portion, is from 1 to 20; the aryl groups represented by $R^5$, $R^6$, $R^7$, $R^8$, or $R^9$ include both substituted aryl groups and unsubstituted aryl groups, wherein the number of carbon atoms of the aryl groups, excluding the carbon atoms of the substituent portion, is from 6 to 14.

34. A color photographic light-sensitive element as in claim 27, wherein said at least one complex is selected from complexes represented by formulae (I), (IIa), (IIIa), (IIIb) and (IVa)

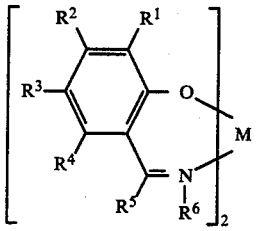

(I)

-continued

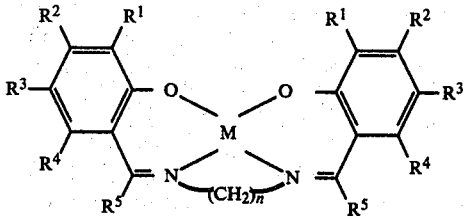

(IIa)

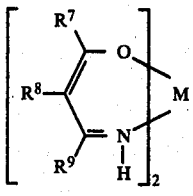

(IIIa)

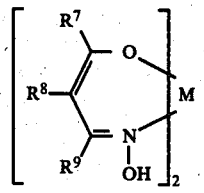

(IIIb)

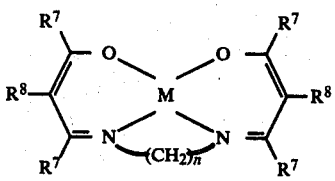

(IVa)

wherein $R^1$, $R^2$, $R^3$, $R^4$, $R^5$, $R^6$, $R^7$, $R^8$, $R^9$, and M each has the same meaning as defined in claim 27, and n is 2 or 3.

35. A color photographic light-sensitive element as in claim 27, wherein said at least one complex is (I) or (IIa).

36. A color photographic light-sensitive element as in claim 27, wherein at least one of $R^1$, $R^2$, $R^3$, and $R^4$ is an alkyl group or an alkoxy group.

37. A color photographic light-sensitive element as in claim 27 or 36, wherein the total number of carbon atoms contained in the groups represented by $R^1$, $R^2$, $R^3$, $R^4$, $R^5$, and $R^6$ is at least 4.

38. A color photographic light-sensitive element as in claim 27 or 34, wherein M is Cu, Co or Ni.

39. A color photographic light-sensitive element as in claim 27 or 34, wherein M is Ni.

40. A color photographic light-sensitive element as in claim 27 or 34, wherein $R^{10}$ is hydrogen, an alkyl group containing from 1 to 22 carbon atoms, an acyl group, a sulfonyl group, a carbamoyl group, a sulfamoyl group, an alkoxycarbonyl group, or a trialkylsilyl group;

A is a group of non-metallic atoms forming a 5- or 6-membered ring in combination with

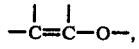

wherein the 5- or 6-membered ring may be substituted with an alkyl group, an alkoxy group, an aryl group, an aryloxy group, an aralkyl group, an aralkoxy group, an alkenyl group, an N-substituted amino group, a heterocyclic group, or by a radical forming a condensed ring, and the alkyl group and aryl group may be substituted with a halogen atom, a hydroxy group, a carboxy group, an alkoxycarbonyl group, an acyloxy group, a sulfo group, a sulfonyloxy group, an amido group, an alkoxy group, or an aryloxy group;

$R^{11}$, $R^{12}$, and $R^{13}$ are each hydrogen, an alkyl group, an alkoxy group, an aryl group, an aryloxy group, an aralkyl group, an aralkoxy group, an alkenyl group, an alkenoxy group, an acylamino group, a halogen atom, an alkylthio group, a diacylamino group, an arylthio group, an alkoxycarbonyl group, an acyloxy group, an acyl group, or a sulfonamido group;

$R^{17}$ is hydrogen, a straight chain or branched chain alkyl group containing from 1 to 22 carbon atoms, or an alkenyl group containing from 3 to 22 carbon atoms; and $R^{18}$ is a straight chain or branched chain alkyl group containing from 1 to 22 carbon atoms, or an alkenyl group containing from 1 to 22 carbon atoms.

41. A color photographic light-sensitive element as in claim 40, wherein the compound represented by formula (V) comprises a bisspiro compound represented by formula (V')

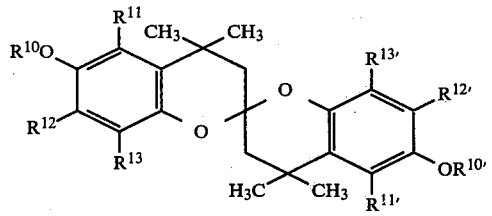

(V')

wherein $R^{10}$, $R^{11}$, $R^{12}$, and $R^{13}$ have the same meanings as $R^{10}$, $R^{11}$, $R^{12}$, and $R^{13}$, respectively in claim 40 and $R^{10'}$, $R^{11'}$, $R^{12'}$, and $R^{13'}$, respectively in claim 40.

42. A color photographic light-sensitive element as in claim 40, wherein said discoloration prevention aid is selected from the compounds represented by formula (V), wherein the total number of carbon atoms contained in $R^{11}$, $R^{12}$, $R^{13}$ is at least 8.

43. A color photographic light-sensitive element as in claim 40, wherein said discoloration prevention aid is selected from the compounds represented by formula (V), wherein $R^{11}$, $R^{12}$, and $R^{13}$ are each an alkyl group, an alkoxy group, an aryl group, an aryloxy group or an alkylthio group.

44. A color photographic light-sensitive element as in claim 41, wherein said discoloration prevention aid is a compound represented by formula (V'), wherein $R^{11}$, $R^{12}$, $R^{13}$, $R^{11'}$, $R^{12'}$, and $R^{13'}$ are each an alkyl group, an alkoxy group, an aryl group, an aryloxy group or an alkylthio group.

45. A color photographic light-sensitive element as in claim 27 or 34, wherein the amount of the complex is from about 0.01 mol to about 10 mols per mol of the magenta coupler.

46. A color photographic light-sensitive element as in claim 27 or 34, wherein the amount of the complex is from 0.05 mol to 2 mols per mol of the magenta coupler.

47. A color photographic light-sensitive element as in claim 27 or 34, wherein the amount of the discoloration prevention aid is from about 0.01 to 10 mols per mol of the magenta coupler.

48. A color photographic light-sensitive element as in claim 27 or 34, wherein the amount of the discoloration prevention aid is from 0.1 mol to 5 mols per mol of the magenta coupler.

49. A color photographic light-sensitive element as in claim 40, wherein the amount of the complex is from about 0.01 mol to about 10 mols per mol of the magneta coupler.

50. A color photographic light-sensitive element as in claim 40, wherein the amount of the complex is from 0.05 mol to 2 mols per mol of the magenta coupler.

51. A color photographic light-sensitive element as in claim 40, wherein the amount of the discoloration prevention aid is from about 0.01 to 10 mols per mol of the magenta coupler.

52. A color photographic light-sensitive element as in claim 40, wherein the amount of the discoloration prevention aid is from 0.1 mol to 5 mols per mol of the magenta coupler.

53. A process for improving the light fastness of a magenta color image as in claim 4, wherein the alkyl groups, cycloalkyl groups, aryl groups, or heterocyclic rings represented by $R^1$, $R^2$, $R^3$, and $R^4$ are linked to the carbon atom of the benzene nucleus through a divalent linking group selected from an oxy group (—O—), a thio group (—S—), an amino group, an oxycarbonyl group, a carbonyl group, a carbamoyl group, a sulfamoyl group, a carbonylamino group, a sulfonylamino group, a sulfonyl group, or a carbonyloxy group.

54. A color photographic light-sensitive element as in claim 30, wherein the alkyl groups, cycloalkyl groups, aryl groups, or heterocyclic rings represented by $R^1$, $R^2$, $R^3$, and $R^4$ are linked to the carbon atom of the benzene nucleus through a divalent linking group selected from an oxy group (—O—), a thio group (—S—), an amino group, an oxycarbonyl group, a carbonyl group, a carbamoyl group, a sulfamoyl group, a carbonylamino group, a sulfonylamino group, a sulfonyl group, or a carbonyloxy group.

* * * * *